US011176882B2

(12) United States Patent
Umezawa

(10) Patent No.: US 11,176,882 B2
(45) Date of Patent: Nov. 16, 2021

(54) DISPLAY DEVICE AND METHOD FOR DRIVING SAME

(71) Applicant: SHARP KABUSHIKI KAISHA, Sakai (JP)

(72) Inventor: Seiji Umezawa, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 16/977,413

(22) PCT Filed: Mar. 29, 2018

(86) PCT No.: PCT/JP2018/013094
§ 371 (c)(1),
(2) Date: Sep. 1, 2020

(87) PCT Pub. No.: WO2019/186857
PCT Pub. Date: Oct. 3, 2019

(65) Prior Publication Data
US 2021/0005138 A1 Jan. 7, 2021

(51) Int. Cl.
*G09G 3/3233* (2016.01)

(52) U.S. Cl.
CPC ... *G09G 3/3233* (2013.01); *G09G 2320/0233* (2013.01); *G09G 2330/02* (2013.01); *G09G 2330/08* (2013.01)

(58) Field of Classification Search
None
See application file for complete search history.

(56) References Cited

U.S. PATENT DOCUMENTS 7,911,423 B2 * 3/2011 Kim ..... G09G 3/3241 345/76
10,140,919 B2 * 11/2018 Nonaka ..... G09G 3/3233
2010/0020059 A1 * 1/2010 Suh ..... G09G 3/3233 345/212
2014/0340290 A1 11/2014 Ono
(Continued)

FOREIGN PATENT DOCUMENTS

JP 2013-044847 A 3/2013
JP 2016-027364 A 2/2016
WO 2013/076774 A1 5/2013

*Primary Examiner* — Matthew Yeung
(74) *Attorney, Agent, or Firm* — ScienBiziP, P.C.

(57) ABSTRACT

An object of the disclosure is to achieve a current-driven display device able to compensate for a variation in threshold voltage of a drive transistor without causing a variation in luminance. A pixel circuit includes an organic EL element; a drive transistor; a first capacitor having a first electrode to be supplied with a reference voltage during a data writing period and a second electrode to be supplied with a data voltage-during a data writing period; a second capacitor having a first electrode connected to the first electrode of the first capacitor and a second electrode connected to a first conduction terminal of the drive transistor; and a short-circuit control transistor having a gate terminal to be supplied with a light emission control signal-, which becomes active during a light emission period, a first conduction terminal connected to the first electrode of the first capacitor, and a second conduction terminal connected to the second electrode of the first capacitor.

16 Claims, 19 Drawing Sheets

(56) References Cited

U.S. PATENT DOCUMENTS

| | | | | |
|---|---|---|---|---|
| 2014/0354517 | A1* | 12/2014 | Chung | G09G 3/3258 345/76 |
| 2015/0379956 | A1 | 12/2015 | Nonaka et al. | |
| 2016/0351160 | A1* | 12/2016 | In | G09G 3/3225 |
| 2017/0221979 | A1* | 8/2017 | Chae | H01L 27/3262 |
| 2018/0082630 | A1* | 3/2018 | Kim | H01L 27/3223 |
| 2019/0295470 | A1* | 9/2019 | Kim | G09G 3/3233 |

* cited by examiner

DISPLAY DEVICE AND METHOD FOR DRIVING SAME

TECHNICAL FIELD

The present disclosure relates to a display device, and more specifically relates to a display device including a current-driven display element, such as an organic EL display device, and a driving method for the stated display device.

BACKGROUND ART

In recent years, organic EL display devices provided with pixel circuits including organic electro luminescence elements (hereinafter referred to as "organic EL elements") have been coming into practical use. The organic EL element is a self-luminous display element that emits light with luminance according to an amount of a current flowing through the organic EL element. The organic EL display device using the organic EL elements being self-luminous display elements can be easily thinned in size, reduced in power consumption, increased in luminance, and the like, as compared with a liquid crystal display device requiring backlights, color filters, and the like. Therefore, development of the organic EL display device has been aggressively advanced in recent years.

With regard to the pixel circuit of the organic EL display device, a thin film transistor (TFT) is typically used as a drive transistor, which is a transistor for controlling the supply of a current to the organic EL element. However, a variation in characteristics of the TFT is likely to occur. Specifically, a variation in threshold voltage is likely to occur. When the variation in threshold voltage occurs in the drive transistors provided in a display portion, a variation in luminance occurs and thus the display quality is degraded. Accordingly, various types of processing (compensation processing) configured to compensate for threshold voltage variations have been proposed.

As the compensation processing methods, well-known are an internal compensation method in which compensation processing is performed by providing a capacitor in a pixel circuit to hold the threshold voltage information of the drive transistor, and an external compensation method in which, for example, an amount of a current flowing through the drive transistor is measured under predetermined conditions with a circuit provided outside the pixel circuit, and compensation processing is performed by correcting a video signal based on the measurement result.

For example, a configuration illustrated in FIG. 20 is known as a configuration of a pixel circuit of an organic EL display device employing the internal compensation method for compensation processing. Note that a pixel circuit 90 illustrated in FIG. 20 is assumed to be a pixel circuit located in the n-th row. The pixel circuits 90 includes one organic EL element OLED, seven transistors T91 to T97 (a drive transistor T91, a writing control transistor T92, a power supply control transistor T93, a light emission control transistor T94, a threshold voltage compensation transistor T95, a first initialization transistor T96, and a second initialization transistor T97), and one data-holding capacitor C9. To the pixel circuit 90, three types of voltages of fixed magnitude (a high-level power supply voltage ELVDD, a low-level power supply voltage ELVSS, and an initialization voltage Vini) are supplied, and additionally supplied are a scanning signal G(n) to be applied to a scanning signal line of the n-th row, a scanning signal G(n−1) to be applied to a scanning signal line of the (n−1)-th row, a light emission control signal EM(n) to be applied to a light emission control line of the n-th row, and a data signal D.

In the pixel circuit 90 illustrated in FIG. 20, after initialization processing has been performed, the writing control transistor T92 and the threshold voltage compensation transistor T95 are turned on, and the power supply control transistor T93, the light emission control transistor T94, the first initialization transistor T96, and the second initialization transistor T97 are turned off, whereby data writing (charging of the data-holding capacitor C9 based on the data signal D) is performed. At this time, as indicated by an arrow denoted by a reference sign 91 in FIG. 21, a data voltage (voltage of the data signal D) is applied to one of the electrodes of the data-holding capacitor C9 via the drive transistor T91, and the high-level power supply voltage ELVDD is applied to the other one of the electrodes of the data-holding capacitor C9 as indicated by an arrow denoted by a reference sign 92 in FIG. 21. By the data being written in this manner, the magnitude of a gate voltage Vg of the drive transistor T91 is expressed by Equation (1) below:

$$Vg = V\text{data} - Vth \tag{1}$$

where Vdata is the data voltage, and Vth is a threshold voltage (absolute value) of the drive transistor T91.

After the writing of the data, a drive current Ioled is supplied to the organic EL element OLED by changing the writing control transistor T92 and the threshold voltage compensation transistor T95 to an off state and changing the power supply control transistor T93 and the light emission control transistor T94 to an on state. As a result, the organic EL element OLED emits light according to the size of the drive current Ioled. At this time, the size of the drive current Ioled is expressed by Equation (2) below:

$$I\text{oled} = (\beta/2)\cdot(Vgs - Vth)^2 \tag{2}$$

where β represents a constant, and Vgs is a source-gate voltage of the drive transistor T91 (a value obtained by subtracting the gate voltage from the source voltage).

When the above Equation (1) is taken into consideration, the source-gate voltage Vgs of the drive transistor T91 is expressed by Equation (3) below.

$$\begin{aligned} Vgs &= ELVDD - Vg \\ &= ELVDD - Vdata + Vth \end{aligned} \tag{3}$$

When the above Equation (3) is substituted in the above Equation (2), Equation (4) below is obtained.

$$I\text{oled} = \beta/2\cdot(ELVDD - V\text{data})^2 \tag{4}$$

The above Equation (4) does not contain the term of the threshold voltage Vth. In other words, regardless of the magnitude of the threshold voltage Vth of the drive transistor T91, the drive current Ioled according to the magnitude of the data voltage Vdata is supplied to the organic EL element OLED. In this way, a variation in the threshold voltage Vth of the drive transistor T91 is compensated.

JP 2013-44847 A discloses an organic EL display device in which compensation accuracy is enhanced by varying the length of a mobility compensation period (a period in which processing to compensate for the mobility of a drive transistor is performed) in accordance with a gray scale level.

CITATION LIST

Patent Literature

PTL 1: JP 2013-44847 A

SUMMARY

Technical Problem

According to the known organic EL display device (the organic EL display device including the pixel circuit 90 in the configuration illustrated in FIG. 20) employing the internal compensation method for compensation processing, data writing is performed in a state in which the high-level power supply voltage ELVDD is applied to one end of the data-holding capacitor C9. However, the magnitude of the high-level power supply voltage ELVDD varies depending on a display pattern, pixel positions, and the like. This is because the magnitude of an IR drop (a voltage drop by the product of a current I and a wiring line resistance R), which affects the high-level power supply voltage ELVDD, differs depending on the display pattern, the pixel positions, and the like. More specifically, since the amount of the current I changes when the display pattern changes, the magnitude of the high-level power supply voltage ELVDD varies depending on the display pattern. In addition, since the magnitude of the wiring line resistance R differs depending on the pixel positions, the magnitude of the high-level power supply voltage ELVDD varies depending on the pixel positions. As discussed above, the luminance may be different despite the data voltage Vdata being the same.

Therefore, an object of the following disclosure is to achieve a current-driven display device able to compensate for a variation in threshold voltage of a drive transistor without causing a variation in luminance.

Solution to Problem

A display device according to some embodiments of the disclosure is a display device that includes a pixel circuit arranged in a matrix shape, a first power source wiring line supplied with a first power supply voltage, a second power source wiring line supplied with a second power supply voltage at a lower voltage level than a voltage level of the first power supply voltage, a third power source wiring line supplied with a third power supply voltage, and a data signal line provided for each column and supplied with a data voltage, the pixel circuit including:

a display element that is provided between the first power source wiring line and the second power source wiring line, and emits light with luminance in accordance with an amount of a current supplied;

a first capacitance element having a first electrode to be supplied with the third power supply voltage during a data writing period, and a second electrode to be supplied with the data voltage during a data writing period;

a drive transistor that is provided to be connected in series to the display element between the first power source wiring line and the second power source wiring line, and has a control terminal connected to the second electrode of the first capacitance element, a first conduction terminal to be supplied with the first power supply voltage during a light emission period, and a second conduction terminal;

a second capacitance element having a first electrode connected to the first electrode of the first capacitance element, and a second electrode connected to the first conduction terminal of the drive transistor; and a short-circuit control transistor having a control terminal to be supplied with a signal that becomes active during a light emission period, a first conduction terminal connected to the first electrode of the first capacitance element, and a second conduction terminal connected to the second electrode of the first capacitance element.

A driving method (for a display device) according to some embodiments of the disclosure is a driving method for a display device equipped with a pixel circuit arranged in a matrix shape, a first power source wiring line supplied with a first power supply voltage, a second power source wiring line supplied with a second power supply voltage at a lower voltage level than a voltage level of the first power supply voltage, a third power source wiring line supplied with a third power supply voltage, and a data signal line provided for each column and supplied with a data voltage, the pixel circuit including:

a display element that is provided between the first power source wiring line and the second power source wiring line, and emits light with luminance in accordance with an amount of a current supplied;

a first capacitance element having a first electrode and a second electrode;

a drive transistor that is provided to be connected in series to the display element between the first power source wiring line and the second power source wiring line, and has a control terminal connected to the second electrode of the first capacitance element, a first conduction terminal, and a second conduction terminal;

a second capacitance element having a first electrode connected to the first electrode of the first capacitance element, and a second electrode connected to the first conduction terminal of the drive transistor; and a short-circuit control transistor having a control terminal, a first conduction terminal connected to the first electrode of the first capacitance element, and a second conduction terminal connected to the second electrode of the first capacitance element, and the driving method including:

supplying the third power supply voltage to the first electrode of the first capacitance element and supplying the data voltage to the second electrode of the first capacitance element, as data writing processing; and supplying the first power supply voltage to the first conduction terminal of the drive transistor and supplying an active signal to the control terminal of the short-circuit control transistor, as light emission processing.

In addition, a driving method (for a display device) according to some embodiments of the disclosure is a driving method for a display device equipped with a pixel circuit arranged in a matrix shape, a first power source wiring line supplied with a first power supply voltage, a second power source wiring line supplied with a second power supply voltage at a lower voltage level than a voltage level of the first power supply voltage, a third power source wiring line supplied with a third power supply voltage, and a data signal line provided for each column and supplied with a data voltage, the pixel circuit including:

a display element that is provided between the first power source wiring line and the second power source wiring line, and emits light with luminance in accordance with an amount of a current supplied;

a first capacitance element having a first electrode and a second electrode;

a drive transistor that is provided to be connected in series to the display element between the first power source wiring line and the second power source wiring line, and has a control terminal connected to the second electrode of the first capacitance element, a first conduction terminal, and a second conduction terminal; and a second capacitance element having a first electrode connected to the first electrode of the first capacitance element and a second electrode connected to the first conduction terminal of the drive transistor, and the driving method including:

electrically connecting the first electrode of the first capacitance element and the third power source wiring line and electrically connecting the second electrode of the first capacitance element and the data signal line as data writing processing, in a state in which the first electrode and the second electrode of the first capacitance element are electrically disconnected, and the first conduction terminal of the drive transistor and the first power source wiring line are electrically disconnected; and electrically connecting the first electrode and the second electrode of the first capacitance element and electrically connecting the first conduction terminal of the drive transistor and the first power source wiring line as light emission processing, in a state in which the first electrode of the first capacitance element and the third power source wiring line are electrically disconnected, and the second electrode of the first capacitance element and the data signal line are electrically disconnected.

Advantageous Effects of Disclosure

According to some embodiments of the disclosure, the pixel circuit is provided with two capacitance elements (the first capacitance element and second capacitance element). During the data writing period, the voltage corresponding to the data voltage and the threshold voltage of the drive transistor is held in the second capacitance element. That is, information of the threshold voltage of the drive transistor is held. Then, in the light emission period, the first electrode and the second electrode of the first capacitance element are short-circuited, and the first electrode of the second capacitance element holding the information of the threshold voltage of the drive transistor as described above is electrically connected with the control terminal of the drive transistor. As a result, when the display element emits light, the influence of the threshold voltage of the drive transistor is canceled, and the drive current of a size according to the data voltage is supplied to the display element. That is, the variation in the threshold voltage of the drive transistor is compensated. The writing of the data (charging of the first capacitance element and the second capacitance element) is performed based on the data voltage and the third power supply voltage. The third power supply voltage, unlike the first power supply voltage, does not contribute to the supply of the drive current to the display element, and therefore is hardly affected by the IR drop. This makes it possible to perform stable data writing. With this, the occurrence of a variation in luminance is prevented when the data is written based on the data voltage of the same magnitude. As described above, a current-driven display device able to compensate for the variation in the threshold voltage of the drive transistor is achieved without causing a variation in luminance.

DESCRIPTION OF EMBODIMENTS

Embodiments will be described below with reference to the accompanying drawings. Note that the following description is based on the premise that i and j each represent an integer equal to or greater than 2, and n represents an integer from 1 to i.

1. First Embodiment

1.1 Overall Configuration

Figure 2:
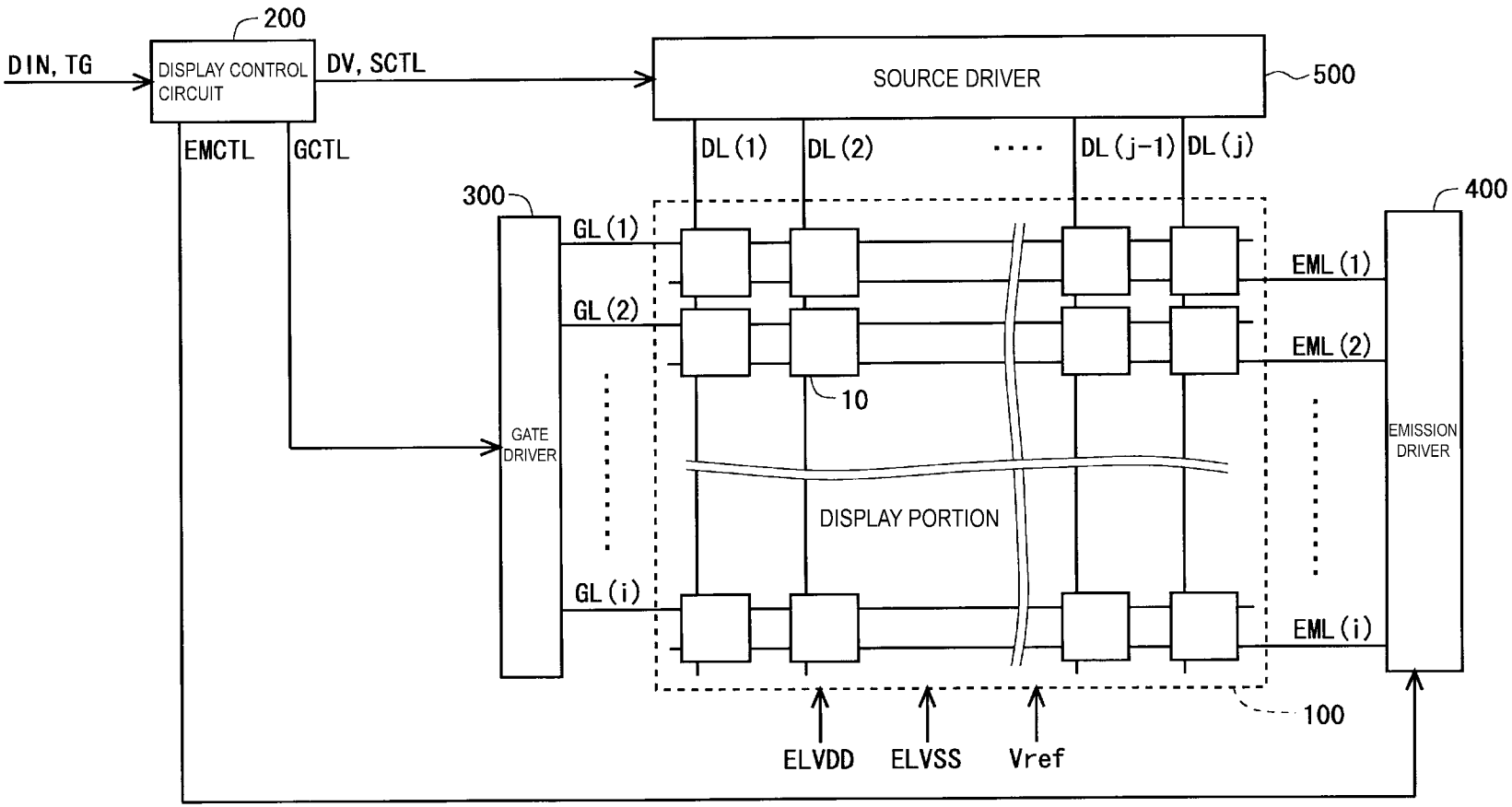
FIG. 2 is a block diagram illustrating an overall configuration of an organic EL display device in the first embodiment.

FIG. 2 is a block diagram illustrating the overall configuration of an organic EL display device according to a first embodiment. The organic EL display device includes a display portion 100, a display control circuit 200, a gate driver 300, an emission driver 400, and a source driver 500. For example, the gate driver 300 and the emission driver 400, in addition to the display portion 100, are provided inside an organic EL panel, and the display control circuit 200 and the source driver 500 are provided on a substrate outside the organic EL panel.

In the display portion 100, i scanning signal lines GL(1) to GL(i) and j data signal lines DL(1) to DL(j) orthogonal to the scanning signal lines are disposed. Further, in the display portion 100, i light emission control lines EML(1) to EML(i) are so disposed as to correspond to the i scanning signal lines GL(1) to GL(i) on a one-to-one basis. Inside the display portion 100, the scanning signal lines GL(1) to GL(i) and the light emission control lines EML(1) to EML(i) are typically parallel to each other. In the display portion 100, (i x j) pixel circuits 10 are so provided in a matrix shape as to correspond to intersections between the i scanning signal lines GL(1) to GL(i) and the j data signal lines DL(1) to DL(ij). In this way, a pixel matrix of i rows by j columns is formed in the display portion 100 by the (i x j) pixel circuits 10 being provided. Details of the pixel circuit 10 will be described later.

Each of the pixel circuits 10 is fixedly supplied with three kinds of voltages (a high-level power supply voltage ELVDD, a low-level power supply voltage ELVSS, and a reference voltage Vref) by using wiring lines (not illustrated). It is sufficient that the voltage level of the reference voltage Vref is equal to or greater than the voltage level of the low-level power supply voltage ELVSS and equal to or lower than the voltage level of the high-level power supply voltage ELVDD. In the following, a wiring line that transfers the high-level power supply voltage ELVDD is referred to as a "first power source wiring line", a wiring line that transfers the low-level power supply voltage ELVSS is referred to as a "second power source wiring line", and a wiring line that transfers the reference voltage Vref is referred to as a "reference power source wiring line". The high-level power supply voltage ELVDD corresponds to a first power supply voltage, the low-level power supply voltage ELVSS corresponds to a second power supply voltage, and the reference voltage Vref corresponds to a third power supply voltage.

Figure 3:
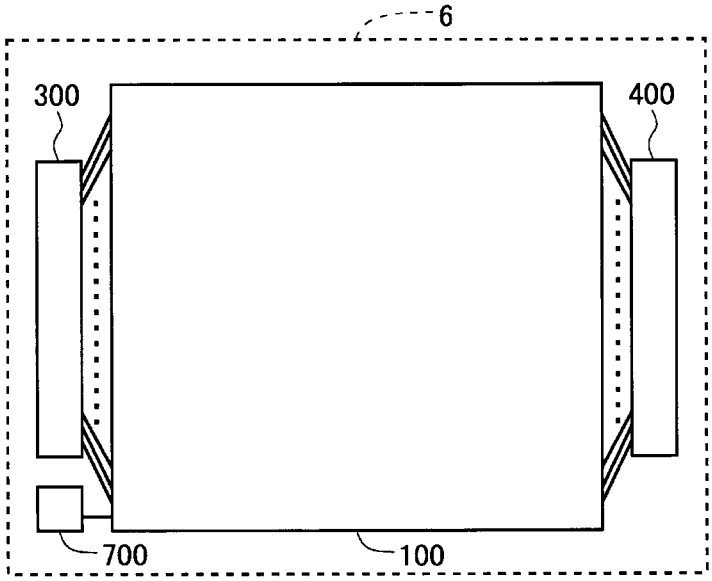
FIG. 3 is a diagram illustrating an arrangement example of a reference voltage generation circuit in the first embodiment.
Figure 4:
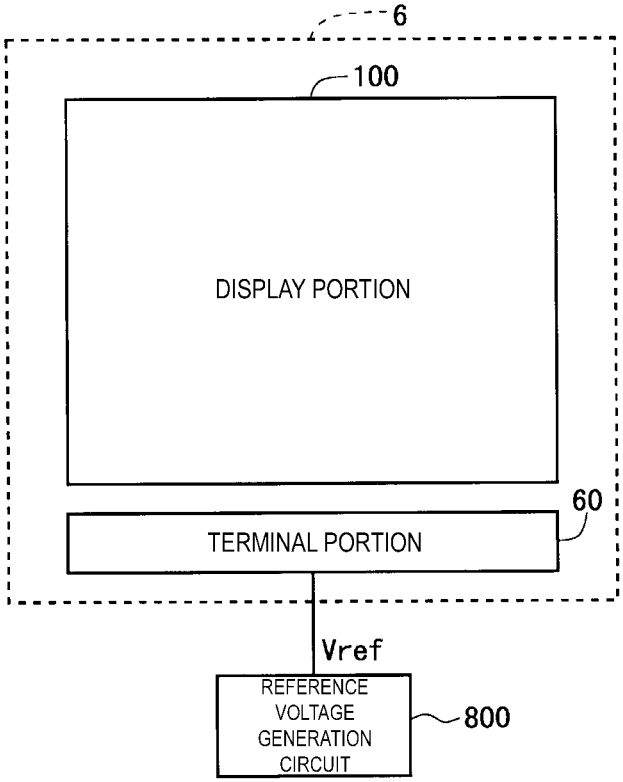
FIG. 4 is a diagram illustrating another arrangement example of a reference voltage generation circuit in the first embodiment.

A reference voltage generation circuit 700 configured to generate the reference voltage Vref may be provided, for example, near the gate driver 300 inside an organic EL panel 6 (or may be provided near the emission driver 400), as illustrated in FIG. 3. For example, as illustrated in FIG. 4, a reference voltage generation circuit 800 may be provided on a substrate different from the substrate constituting the organic EL panel 6, and the reference voltage Vref may be supplied into the pixel circuit via a terminal portion 60.

Actions of the constituent elements illustrated in FIG. 2 will be described below. The display control circuit 200 receives an input image signal DIN and a timing signal group (a horizontal synchronization signal, a vertical synchronization signal, and the like) TG transmitted from the outside, and outputs a digital video signal DV, a gate control signal GCTL for controlling the actions of the gate driver 300, an emission driver control signal EMCTL for controlling the actions of the emission driver 400, and a source control signal SCTL for controlling the actions of the source driver 500. The gate control signal GCTL and the emission driver control signal EMCTL each include a start pulse signal and a clock signal. The source control signal SCTL includes a start pulse signal (a source start pulse signal), a clock signal (a source clock signal), a latch strobe signal, and the like.

The gate driver 300 is connected with the i scanning signal lines GL(1) to GL(i). The gate driver 300 includes a shift register, a logic circuit, and the like. The gate driver 300 drives the i scanning signal lines GL(1) to GL(i) based on the gate control signal GCTL outputted from the display control circuit 200. More specifically, the gate driver 300 sequentially selects one scanning signal line from among the i scanning signal lines GL(1) to GL(i), and applies an active scanning signal (in the present embodiment, a low-level scanning signal) to the selected scanning signal line.

The emission driver 400 is connected with the i light emission control lines EML(1) to EML(i). The emission driver 400 includes a shift register, a logic circuit, and the like. The emission driver 400 drives the i light emission control lines EML(1) to EML(i) based on the emission driver control signal EMCTL outputted from the display control circuit 200. More specifically, the emission driver 400 sequentially selects one light emission control line from among the i light emission control lines EML(1) to EML(i), and applies an active light emission control signal (in the present embodiment, a low-level light emission control signal) to the selected light emission control line.

The source driver 500 is connected with the j data signal lines DL(1) to DL(j). The source driver 500 receives the digital video signal DV and the source control signal SCTL outputted from the display control circuit 200, and applies data signals to the j data signal lines DL(1) to DL(j). The source driver 500 includes an j-bit shift register, a sampling circuit, a latch circuit, j D/A converters, and the like, which are not illustrated. The shift register includes j registers cascade-connected with each other. The shift register sequentially transfers a pulse of the source start pulse signal to be supplied to a first stage register from an input end to an output end based on the source clock signal. In response to this pulse transferring, sampling pulses are output from respective stages of the shift register. The sampling circuit stores the digital video signal DV based on the sampling pulses. The latch circuit acquires and holds the digital video signal DV for one row stored in the sampling circuit in accordance with the latch strobe signal. The D/A converters are provided to correspond to the respective data signal lines DL(1) to DL(j). The D/A converters convert the digital video signal DV held in the latch circuit into analog voltages. The converted analog voltages are simultaneously applied, as data signals, to all of the data signal lines DL(1) to DL(j).

As described above, the i scanning signal lines GL(1) to GL(i), the i light emission control lines EML(1) to EML(i), and the j data signal lines DL(1) to DL(j) are driven to display the image based on the input image signal DIN on the display portion 100.

In the following, a scanning signal supplied to the scanning signal line GL(n) of the n-th row is denoted by a reference sign G(n), and a light emission control signal supplied to the light emission control line EML(n) of the n-th row is denoted by a reference sign EM(n).

1.2 Configuration of Pixel Circuit

Next, a configuration of the pixel circuit 10 in the present embodiment will be described while referring to FIG. 1. Here, the pixel circuit 10 located in the n-th row is focused on. The pixel circuit 10 includes one organic EL element OLED as a display element, six transistors (a first writing control transistor T1, a second writing control transistor T2, a drive transistor T3, a light emission control transistor T4, a short-circuit control transistor T5, and an electric discharge control transistor T6), and two capacitance elements (a first capacitor C1 and a second capacitor C2). The above-mentioned six transistors are all p-channel thin film transistors.

Regarding the p-channel transistor, of terminals of a drain and a source, the terminal having a higher potential is referred to as "source". However, in some transistors within the pixel circuit 10, the relationship of potential levels between two terminals other than a gate terminal (a control terminal) is interchanged depending on circuit conditions. Accordingly, as for each of the transistors in the pixel circuit 10, in the following description, one of the two terminals other than the gate terminal is referred to as a "first conduction terminal", and the other one is referred to as a "second conduction terminal".

The second conduction terminal of the second writing control transistor T2, the first conduction terminal of the short-circuit control transistor T5, the first electrode of the first capacitor C1, and the first electrode of the second capacitor C2 are connected to one another. A region (wiring line) where they are connected to one another is referred to as a "first node". The first node is denoted by a reference sign N1. The second conduction terminal of the first writing control transistor T1, the gate terminal of the drive transistor T3, the second conduction terminal of the short-circuit control transistor T5, and the second electrode of the first capacitor C1 are connected to one another. A region (wiring line) where they are connected to one another is referred to as a "second node". The second node is denoted by a reference sign N2. The first conduction terminal of the drive transistor T3, the second conduction terminal of the light emission control transistor T4, and the second electrode of the second capacitor C2 are connected to one another. A region (wiring line) where they are connected to one another is referred to as a "third node". The third node is denoted by a reference sign N3.

As for the first writing control transistor T1, the gate terminal is connected to the scanning signal line GL(n) and the gate terminal of the second writing control transistor T2, the first conduction terminal is connected to the data signal line DL for transferring a data signal D, and the second conduction terminal is connected to the second node N2. As for the second writing control transistor T2, the gate terminal is connected to the scanning signal line GL(n) and the gate terminal of the first writing control transistor T1, the first conduction terminal is connected to the reference power source wiring line, and the second conduction terminal is connected to the first node N1. As for the drive transistor T3, the gate terminal is connected to the second node N2, the first conduction terminal is connected to the third node N3, and the second conduction terminal is connected to the first conduction terminal of the electric discharge control transistor T6 and an anode terminal of the organic EL element OLED.

As for the light emission control transistor T4, the gate terminal is connected to the light emission control line EML(n), the first conduction terminal is connected to the first power source wiring line, and the second conduction terminal is connected to the third node N3. As for the short-circuit control transistor T5, the gate terminal is connected to the light emission control line EML(n), the first conduction terminal is connected to the first node N1, and the second conduction terminal is connected to the second node N2. As for the electric discharge control transistor T6, the gate terminal is connected to a control line that transmits a logical inversion signal of the light emission control signal EM(n), the first conduction terminal is connected to the second conduction terminal of the drive transistor T3 and the anode terminal of the organic EL element OLED, and the second conduction terminal is connected to a cathode terminal of the organic EL element OLED and the second power source wiring line.

As for the first capacitor C1, the first electrode is connected to the first node N1, and the second electrode is connected to the second node N2. As for the second capacitor C2, the first electrode is connected to the first node N1, and the second electrode is connected to the third node N3. As can be understood from FIG. 1, the first capacitor C1 and the second capacitor C2 are provided to be connected in series between the gate terminal and the first conduction terminal of the drive transistor T3. As for the organic EL element OLED, the anode terminal is connected to the second conduction terminal of the drive transistor T3 and the first conduction terminal of the electric discharge control transistor T6, and the cathode terminal is connected to the second conduction terminal of the electric discharge control transistor T6 and the second power source wiring line. In the following, the capacitance value of the first capacitor C1 is denoted also by the reference sign C1, and the capacitance value of the second capacitor C2 is denoted also by the reference sign C2.

According to the connection relationship described above, as for the pixel circuit 10 located in the n-the row, a scanning signal G(n) to be applied to the scanning signal line GL(n) of the n-th row is supplied to the gate terminal of the first writing control transistor T1 and the gate terminal of the second writing control transistor T2, a light emission control signal EM(n) to be applied to the light emission control line EML(n) of the n-th row is supplied to the gate terminal of the light emission control transistor T4 and the gate terminal of the short-circuit control transistor T5, and a logical inversion signal of the light emission control signal EM(n) is supplied to the gate terminal of the electric discharge control transistor T6. A data voltage (a voltage of the data signal D) Vdata is supplied to the first conduction terminal of the first writing control transistor T1, and the reference voltage Vref is supplied to the first conduction terminal of the second writing control transistor T2. The high-level power supply voltage ELVDD is supplied to the first conduction terminal of the light emission control transistor T4, and the low-level power supply voltage ELVSS is supplied to the second conduction terminal of the electric discharge control transistor T6 and the cathode terminal of the organic EL element OLED.

In the present embodiment, the first capacitance element is implemented by the first capacitor C1, and the second capacitance element is implemented by the second capacitor C2.

1.3 Driving Method

Figure 5:
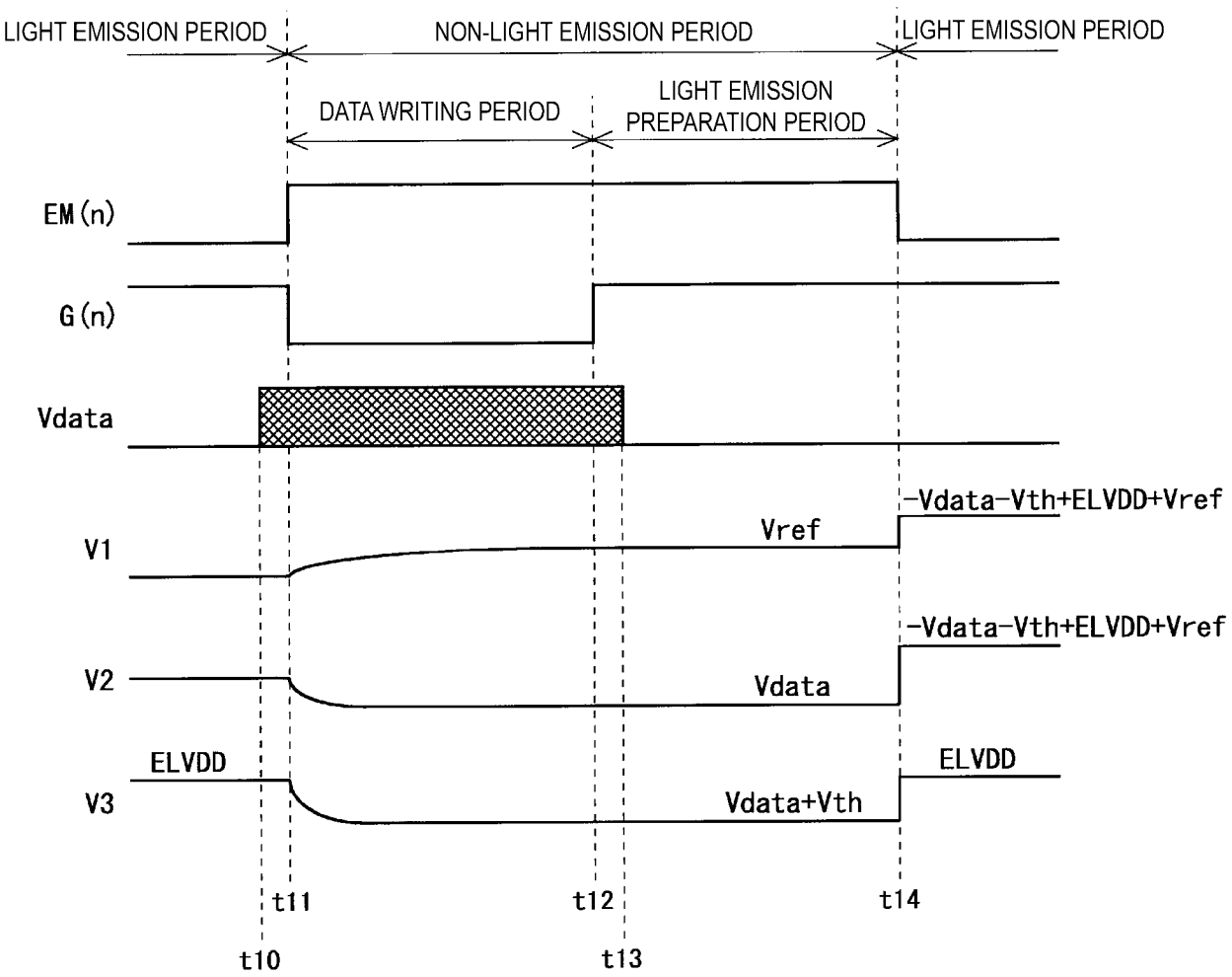
FIG. 5 is a timing chart for describing a driving method for a pixel circuit in the first embodiment.

Next, a driving method will be described. FIG. 5 is a timing chart for describing a driving method for the pixel circuit (the pixel circuit illustrated in FIG. 1) 10 located in the n-th row. In FIG. 5, V1 represents the potential of the first node N1, V2 represents the potential of the second node N2, and V3 represents the potential of the third node N3. A period before time t11 and a period after time t14 are light emission periods of the pixel circuit 10 located in the n-th row, and a period from the time t11 to the time t14 is a non-light emission period of the pixel circuit 10 located in the n-th row. Of the non-light emission period, a period during which the first capacitor C1 and the second capacitor C2 are charged based on the data voltage Vdata (a period from the time t11 to time t12) is referred to as a "data writing period", and of the non-light emission period, a period other than the data writing period (a period from the time t12 to the time t14) is referred to as a "light emission preparation period". As for the data voltage Vdata in FIG. 5, a period during which a desired voltage for the pixel circuit 10 located in the n-th row is applied to the data signal line DL is indicated by a shaded portion.

Figure 6:
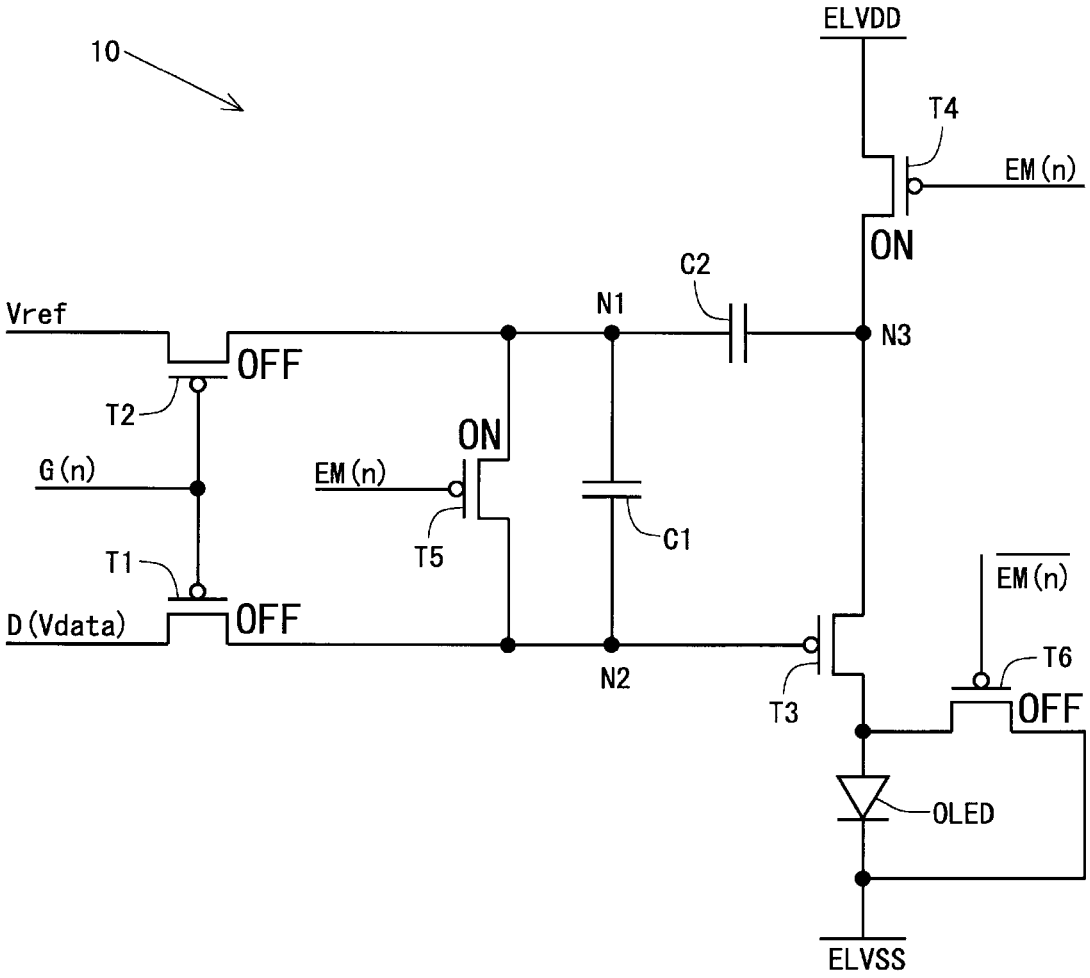
FIG. 6 is a diagram for describing actions in a light emission period in the first embodiment.

In the period before time t10, the light emission control signal EM(n) is at a low level and the scanning signal G(n) is at a high level. At this time, as illustrated in FIG. 6, the light emission control transistor T4 and the short-circuit control transistor T5 are in an on state, and the first writing control transistor T1, the second writing control transistor T2, and the electric discharge control transistor T6 are in an off state. As a result, a drive current of a size according to the voltage between the first conduction terminal and the gate terminal of the drive transistor T3 is supplied to the organic EL element OLED, so that the organic EL element OLED emits light. Note that the potential V1 of the first node N1 and the potential V2 of the second node N2 are potentials corresponding to the data voltage Vdata in the data writing period of the previous frame, and the potential V3 of the third node N3 is a potential based on the high-level power supply voltage ELVDD.

At the time t10, the voltage level of the data voltage Vdata comes to be a desired voltage level for the pixel circuit 10 located in the n-th row. At this time, the voltage level of the light emission control signal EM(n) and the voltage level of the scanning signal G(n) do not change. The reason for changing the voltage level of the data voltage Vdata slightly before the time t11 at which the voltage level of the light emission control signal EM(n) and the voltage level of the scanning signal G(n) start to change, is to increase a charging rate of the first capacitor C1 and the second capacitor C2 in the data writing period.

Figure 7:
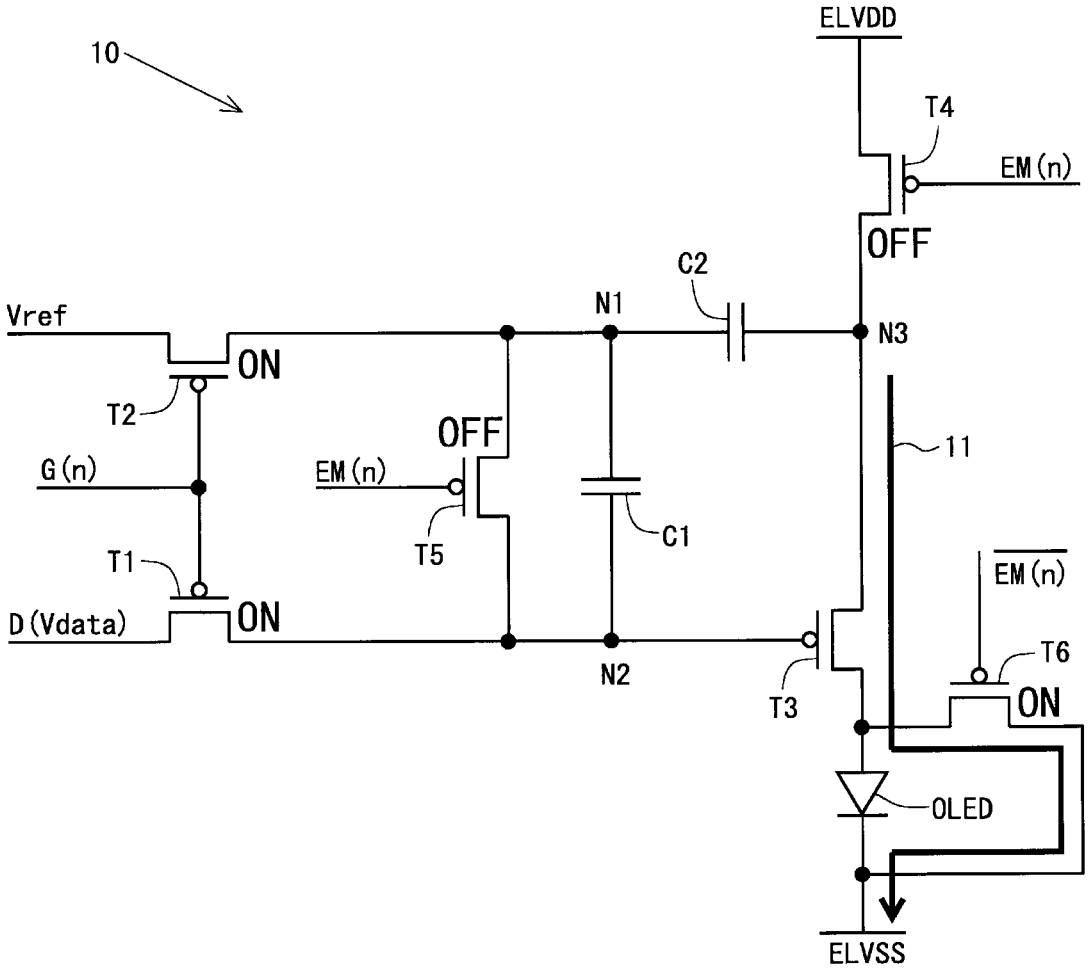
FIG. 7 is a diagram for describing actions in a data writing period in the first embodiment.

At the time t11, the light emission control signal EM(n) is changed from the low level to the high level. This turns off the light emission control transistor T4 and the short-circuit control transistor T5, and turns on the electric discharge control transistor T6, as illustrated in FIG. 7. By the light emission control transistor T4 being turned off, the supply of the drive current to the organic EL element OLED is blocked, and the organic EL element OLED is turned to a non-emitting state (switch-off state). In addition, by the short-circuit control transistor T5 being turned off, the first node N1 and the second node N2 are electrically disconnected.

At the time t11, the scanning signal G(n) is changed from the high level to the low level. This turns on the first writing control transistor T1 and the second writing control transistor T2, as illustrated in FIG. 7. When the first writing control transistor T1 is turned on, the data voltage Vdata is supplied to the second node N2; when the second writing control transistor T2 is turned on, the reference voltage Vref is supplied to the first node N1. Thus, the potential of the first node N1 changes toward a potential based on the reference voltage Vref, and the potential of the second node N2 changes toward a potential based on the data voltage Vdata. As a result, an electrical charge Q(C1)1*a* expressed by Equation (5) below is accumulated on the first electrode side (first node N1 side) of the first capacitor C1, and an electrical charge Q(C1)2*a* expressed by Equation (6) below is accumulated on the second electrode side (second node N2 side) of the first capacitor C1.

$$\begin{aligned} Q(C1)1a &= C1(V1 - V2) \\ &= C1(Vref - Vdata) \end{aligned} \tag{5}$$

$$\begin{aligned} Q(C1)2a &= C1(V2 - V1) \\ &= C1(Vdata - Vref) \end{aligned} \tag{6}$$

Since the light emission control transistor T4 is in the off state and the electric discharge control transistor T6 is in the on state, the potential of the third node N3 decreases because the electrical charge flows out from the third node N3 passing through the drive transistor T3 and the electric discharge control transistor T6, as indicated by an arrow denoted by a reference sign 11 in FIG. 7. To be specific, the potential V3 of the third node N3 decreases until a difference between the potential V2 of the second node N2 and the potential V3 of the third node N3 becomes equal to a threshold voltage Vth of the drive transistor T3 (where a relation of "V2<V3" is satisfied). This causes the potential V3 of the third node N3 to be "Vdata+Vth". As a result, an electrical charge Q(C2)1*a* expressed by Equation (7) below is accumulated on the first electrode side (first node N1 side) of the second capacitor C2.

$$\begin{aligned} Q(C2)1a &= C2(V1 - V3) \\ &= C2(Vref - (Vdata + Vth)) \\ &= C2(Vref - Vdata - Vth) \end{aligned} \tag{7}$$

As discussed above, at the end time point of the data writing period, an electrical charge Q(N1)a expressed by Equation (8) below is accumulated in the first node N1, and an electrical charge Q(N2)a expressed by Equation (9) below is accumulated in the second node N2.

$$\begin{aligned} Q(N1)a &= Q(C1)1a + Q(C2)1a \\ &= C1(Vref - Vdata) + C2(Vref - Vdata - Vth) \end{aligned} \tag{8}$$

$$\begin{aligned} Q(N2)a &= Q(C1)2a \\ &= C1(Vdata - Vref) \end{aligned} \tag{9}$$

Figure 8:
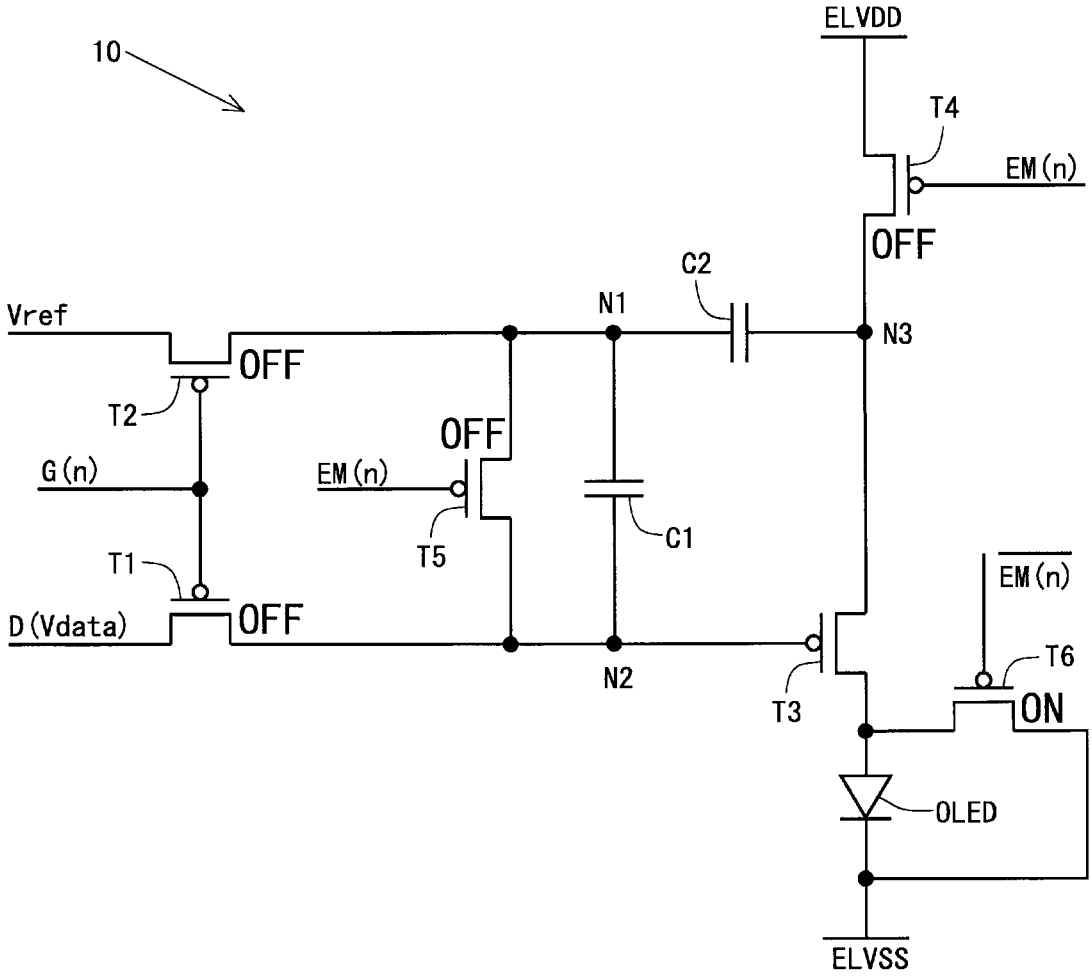
FIG. 8 is a diagram for describing actions in a light emission preparation period in the first embodiment.

At the time t12, the scanning signal G(n) is changed from the low level to the high level. This turns off the first writing control transistor T1 and the second writing control transistor T2, as illustrated in FIG. 8. At this time, there is no change in the electrical charge accumulated in the first capacitor C1 and the electrical charge accumulated in the second capacitor C2. Because of this, during the light emission preparation period, a state where the electrical charge Q(N1)a expressed by the above Equation (8) is accumulated in the first node N1 is maintained, and a state where the electrical charge Q(N2)a expressed by the above Equation (9) is accumulated in the second node N2 is maintained. At the time t13, the voltage level of the data voltage Vdata comes to be a desired voltage level for the pixel circuit 10 located in the (n+1)-th row.

At the time t14, the light emission control signal EM(n) is changed from the high level to the low level. This turns on the light emission control transistor T4 and the short-circuit control transistor T5, and turns off the electric discharge control transistor T6, as illustrated in FIG. 6. By the short-circuit control transistor T5 being turned on, the first node N1 and the second node N2 are short-circuited. As a result, the potential V1 of the first node N1 and the potential V2 of the second node N2 become equal to each other. Thus, both an electrical charge Q(C1)1*b* accumulated on the first electrode side (first node N1 side) of the first capacitor C1 and an electrical charge Q(C1)2*b* accumulated on the second electrode side (second node N2 side) of the first capacitor C1 become 0. When the gate voltage of the drive transistor T3 (the potential V2 of the second node N2) in the light emission period is taken as Vout, the magnitude of an electrical charge Q(C2)1*b* accumulated on the first electrode side (first node N1 side) of the second capacitor C2 is expressed by Equation (10) below.

$$Q(C2)1b = C2(V1 - V3) \quad (10)$$
$$= C2(V2 - V3)$$
$$= C2(Vout - ELVDD)$$

As described above, in the light emission period, the magnitude of an electrical charge Q(N1)b accumulated in the first node N1 is expressed by Equation (11) below, and the magnitude of an electrical charge Q(N2)b accumulated in the second node N2 is expressed by Equation (12) below.

$$Q(N1)b = Q(C1)1b + Q(C2)1b \quad (11)$$
$$= 0 + C2(Vout - ELVDD)$$
$$= C2(Vout - ELVDD)$$

$$Q(N2)b = Q(C1)2a \quad (12)$$
$$= 0$$

Here, even in the light emission preparation period (see FIG. 8) and the light emission period (see FIG. 6), the first writing control transistor T1 and the second writing control transistor T2 are in the off state. In other words, the first writing control transistor T1 and the second writing control transistor T2 are both maintained in the off state in the periods before and after the time t14. Therefore, based on the principle of charge conservation, the total amount of the electrical charge of the first node N1 and the electrical charge of the second node N2 does not change in the periods before and after the time t14. That is, Equation (13) below holds.

$$Q(N1)a+Q(N2)a=Q(N1)b+Q(N2)b \quad (13)$$

By substituting the above Equations (8), (9), (11), and (12) in the above Equation (13), Equation (14) below is obtained.

$$C2(Vref-Vdata-Vth)=C2(Vout-ELVDD) \quad (14)$$

From the above Equation (14), Equation (15) below is obtained.

$$Vout=-Vdata-Vth+ELVDD+Vref \quad (15)$$

At this time, a voltage Vgs between the first conduction terminal and the gate terminal of the drive transistor T3 is expressed by Equation (16) below.

$$Vgs = ELVDD - Vout \quad (16)$$
$$= Vdata + Vth - Vref$$

A drive current Ioled is determined by the above Equation (2). When the above Equation (16) is substituted in the above Equation (2), Equation (17) below is obtained.

$$Ioled=\beta/2\cdot(Vdata-Vref)^2 \quad (17)$$

The above Equation (17) does not contain the term of the threshold voltage Vth. In other words, regardless of the magnitude of the threshold voltage Vth of the drive transistor T3, the drive current Ioled according to the magnitude of the data voltage Vdata is supplied to the organic EL element OLED. Thus, a variation in the threshold voltage Vth of the drive transistor T3 is compensated.

The relationship between the capacitance value of the first capacitor C1 and the capacitance value of the second capacitor C2 is not particularly limited; however, as understood from the above-described actions, the second capacitor C2 functions to hold a voltage corresponding to the data voltage Vdata and the threshold voltage Vth of the drive transistor T3. In order to compensate for the variation in the threshold voltage Vth of the drive transistor T3, the voltage written into the second capacitor C2 needs to be reliably maintained. Therefore, it is preferable that the capacitance value of the second capacitor C2 be larger than the capacitance value of the first capacitor C1 in order to prevent the electrical charge accumulated in the second capacitor C2 from being discharged.

In the present embodiment, the actions performed in the period from the time t11 to the time t12 correspond to data writing processing, and the actions performed in the period before the time t11 and the period after the time t14 correspond to light emission processing.

1.4 Effects

According to the present embodiment, two capacitors (the first capacitor C1 and the second capacitor C2) are provided in the pixel circuit 10. During the data writing period, the voltage corresponding to the data voltage Vdata and the threshold voltage Vth of the drive transistor T3 is held in the second capacitor C2. That is, information of the threshold voltage Vth of the drive transistor T3 is held. Then, in the light emission period, the first electrode and the second electrode of the first capacitor C1 are short-circuited, and the first electrode of the second capacitor C2 holding the information of the threshold voltage Vth of the drive transistor T3 as described above is electrically connected with the gate terminal of the drive transistor T3. As a result, when the organic EL element OLED emits light, the influence of the threshold voltage Vth is canceled, and the drive current of a size according to the data voltage Vdata is supplied to the organic EL element OLED. That is, the variation in the threshold voltage Vth of the drive transistor T3 is compensated. The writing of the data (charging of the first capacitor C1 and the second capacitor C2) is performed based on the data voltage Vdata and the reference voltage Vref. The reference voltage Vref, unlike the high-level power supply voltage ELVDD, does not contribute to the supply of the drive current to the organic EL element OLED, and therefore is hardly affected by the IR drop. This makes it possible to perform stable data writing. With this, the occurrence of a variation in luminance is prevented when the data is written based on the data voltage Vdata of the same magnitude. As described above, according to the present embodiment, an organic EL display device able to compensate for the variation in the threshold voltage Vth of the drive transistor T3 is achieved without causing a variation in luminance.

1.5 Modification Example

In the above-described first embodiment, the first capacitor C1 (see FIG. 1) is provided between the first node N1 and the second node N2 in the pixel circuit 10. However, similar results may be obtained when C1 is set to be 0 (C1=0) in the above Equations (5), (6), (8), and (9). That is, it is not absolutely necessary to provide the first capacitor C1. Accordingly, it is also possible to employ the pixel circuit 10 in a configuration in which the first capacitor C1 is removed from the configuration illustrated in FIG. 1. In this case, only one capacitor (the second capacitor C2) is provided as a capacitance element in the pixel circuit 10.

2. Second Embodiment

2.1 Overall Configuration

The overall configuration in the present embodiment is substantially similar to that of the first embodiment (see FIG. 2). However, in the present embodiment, an initialization voltage *Vini* is supplied to a pixel circuit 10 in addition to the above-described three kinds of voltages (the high-level power supply voltage ELVDD, the low-level power supply voltage ELVSS, and the reference voltage Vref), as the voltages having fixed voltage levels. The initialization voltage *Vini* is a voltage for initializing a state of the inside of the pixel circuit 10. Hereinafter, a wiring line that transfers the initialization voltage *Vini* is referred to as an "initialization power source wiring line". In the present embodiment, the initialization voltage *Vini* may also be used as the reference voltage Vref.

2.2 Configuration of Pixel Circuit

Figure 9:
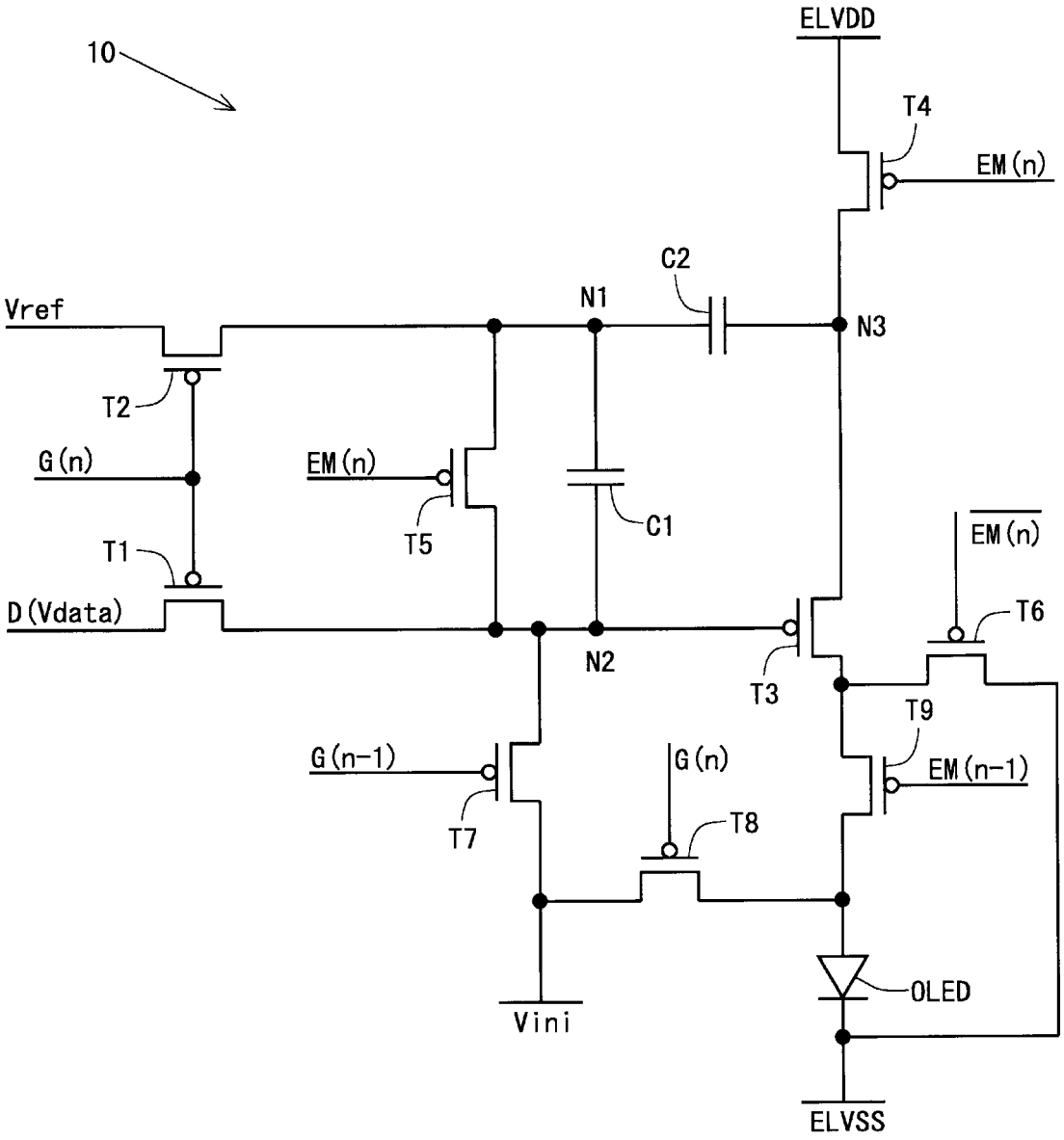
FIG. 9 is a circuit diagram illustrating a configuration of a pixel circuit in a second embodiment.

The configuration of the pixel circuit 10 in the present embodiment will be described while referring to FIG. 9. As illustrated in FIG. 9, the pixel circuit 10 includes one organic EL element OLED as a display element, nine transistors (a first writing control transistor T1, a second writing control transistor T2, a drive transistor T3, a light emission control transistor T4, a short-circuit control transistor T5, an electric discharge control transistor T6, a first initialization transistor T7, a second initialization transistor T8, and an initialization control transistor T9), and two capacitance elements (a first capacitor C1 and a second capacitor C2). That is, in addition to the constituent elements of the first embodiment, the first initialization transistor T7, the second initialization transistor T8, and the initialization control transistor T9 are provided in the pixel circuit 10 of the present embodiment. Different points from the first embodiment will be mainly described below.

As for the first initialization transistor T7, the gate terminal is connected to a scanning signal line GL(n−1), the first conduction terminal is connected to a second node N2, and the second conduction terminal is connected to the second conduction terminal of the second initialization transistor T8 and an initialization power source wiring line. As for the second initialization transistor T8, the gate terminal is connected to a scanning signal line GL(n), the first conduction terminal is connected to the second conduction terminal of the initialization control transistor T9 and the anode terminal of the organic EL element OLED, and the second conduction terminal is connected to the second conduction terminal of the first initialization transistor T7 and the initialization power source wiring line. As for the initialization control transistor T9, the gate terminal is connected to a light emission control line EML(n−1), the first conduction terminal is connected to the second conduction terminal of the drive transistor T3 and the first conduction terminal of the electric discharge control transistor T6, and the second conduction terminal is connected to the first conduction terminal of the second initialization transistor T8 and the anode terminal of the organic EL element OLED. The gate terminal of the initialization control transistor T9 may be connected to the scanning signal line GL(n−1).

In the present embodiment, the second conduction terminal of the drive transistor T3 is connected to the first conduction terminal of the electric discharge control transistor T6 and the first conduction terminal of the initialization control transistor T9, the first conduction terminal of the electric discharge control transistor T6 is connected to the second conduction terminal of the drive transistor T3 and the first conduction terminal of the initialization control transistor T9, and the anode terminal of the organic EL element OLED is connected to the first conduction terminal of the second initialization transistor T8 and the second conduction terminal of the initialization control transistor T9.

According to the connection relationship described above, as for the pixel circuit 10 located in the n-the row, a scanning signal G(n−1) to be applied to the scanning signal line GL(n−1) of the (n−1)-th row is supplied to the gate terminal of the first initialization transistor T7; a scanning signal G(n) to be applied to the scanning signal line GL(n) of the n-th row is supplied to the gate terminal of the first writing control transistor T1, the gate terminal of the second writing control transistor T2, and the gate terminal of the second initialization transistor T8; a light emission control signal EM(n−1) to be applied to the light emission control line EML(n−1) of the (n−1)-th row is supplied to the gate terminal of the initialization control transistor T9; a light emission control signal EM(n) to be applied to a light emission control line EML(n) of the n-th row is supplied to the gate terminal of the light emission control transistor T4 and the gate terminal of the short-circuit control transistor T5; and a logical inversion signal of the light emission control signal EM(n) is supplied to the gate terminal of the electric discharge control transistor T6. A data voltage (a voltage of the data signal D) Vdata is supplied to the first conduction terminal of the first writing control transistor T1, and the reference voltage Vref is supplied to the first conduction terminal of the second writing control transistor T2. The high-level power supply voltage ELVDD is supplied to the first conduction terminal of the light emission control transistor T4, the low-level power supply voltage ELVSS is supplied to the second conduction terminal of the electric discharge control transistor T6 and the cathode terminal of the organic EL element OLED, and the initialization voltage *Vini* is supplied to the second conduction terminal of the first initialization transistor T7 and the second conduction terminal of the second initialization transistor T8.

2.3 Driving Method

Figure 10:
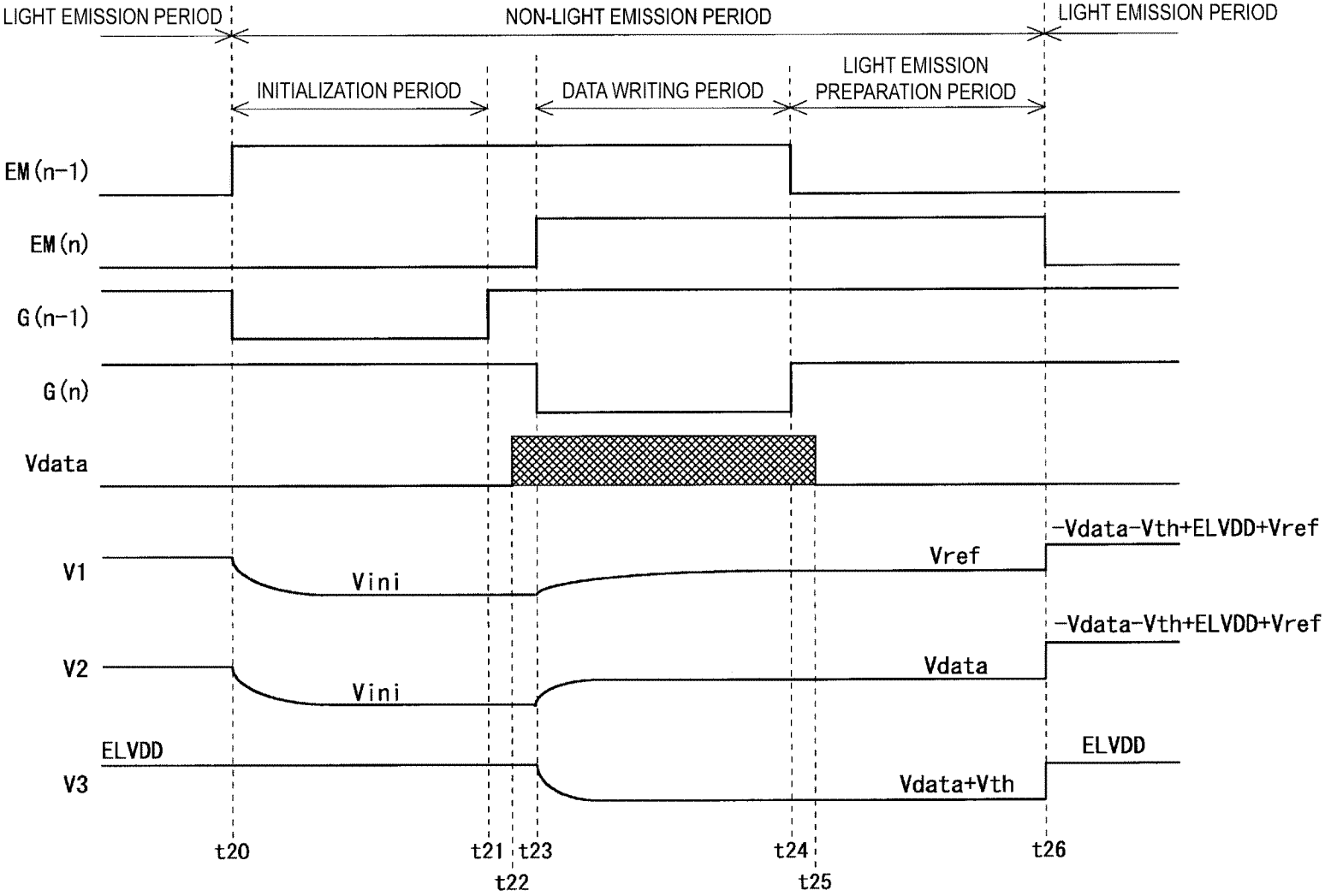
FIG. 10 is a timing chart for describing a driving method for a pixel circuit in the second embodiment.

Next, a driving method will be described. FIG. 10 is a timing chart for describing a driving method for the pixel circuit (the pixel circuit illustrated in FIG. 9) 10 located in the n-th row. A period before time t20 and a period after time t26 are light emission periods of the pixel circuit 10 located in the n-th row, and a period from the time t20 to the time t26 are a non-light emission period of the pixel circuit 10 located in the n-th row. With regard to the non-light emission period, a period from the time t20 to time t21 is an initialization period, a period from the time t23 to time t24 is a data writing period, and a period from the time t24 to time t26 is a light emission preparation period. Here, the initialization period refers to a period during which the initialization of the gate voltage of the drive transistor T3 (a potential V2 of the second node N2) is performed.

Figure 11:
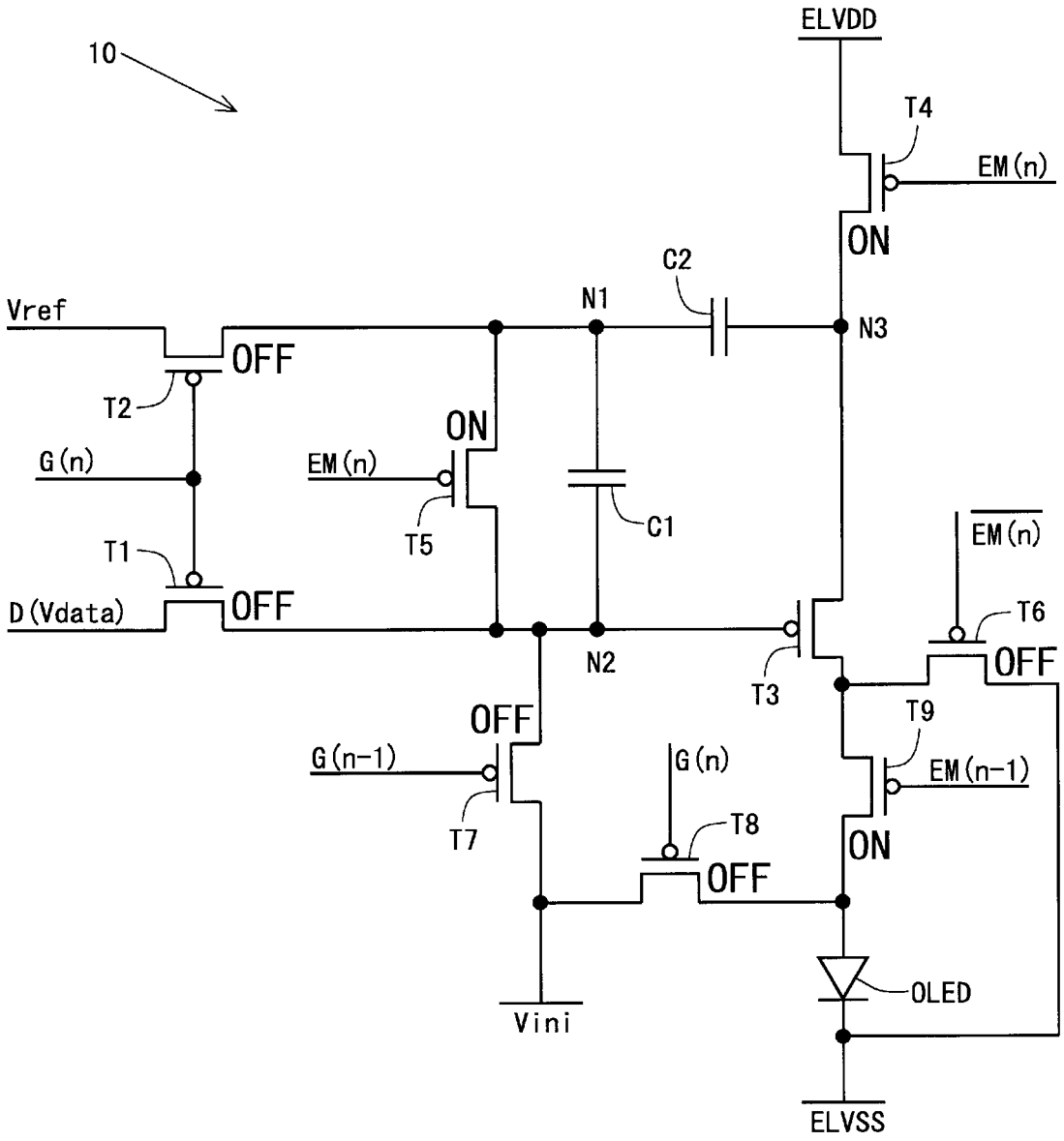
FIG. 11 is a diagram for describing actions in a light emission period in the second embodiment.

In the period before the time t20, the light emission control signal EM(n−1) is at a low level, the light emission control signal EM(n) is at a low level, the scanning signal G(n−1) is at a high level, and the scanning signal G(n) is at a high level. At this time, as illustrated in FIG. 11, the light emission control transistor T4, the short-circuit control transistor T5 and the initialization control transistor T9 are in an on state, and the first writing control transistor T1, the second writing control transistor T2, the electric discharge control transistor T6, the first initialization transistor T7, and the second initialization transistor T8 are in an off state. As a result, a drive current of a size according to the voltage between the first conduction terminal and the gate terminal of the drive transistor T3 is supplied to the organic EL element OLED, so that the organic EL element OLED emits light. Note that a potential V1 of a first node N1 and the potential V2 of the second node N2 are potentials corresponding to the data voltage Vdata in the data writing period of the previous frame, and a potential V3 of a third node N3 is a potential based on the high-level power supply voltage ELVDD.

Figure 12:
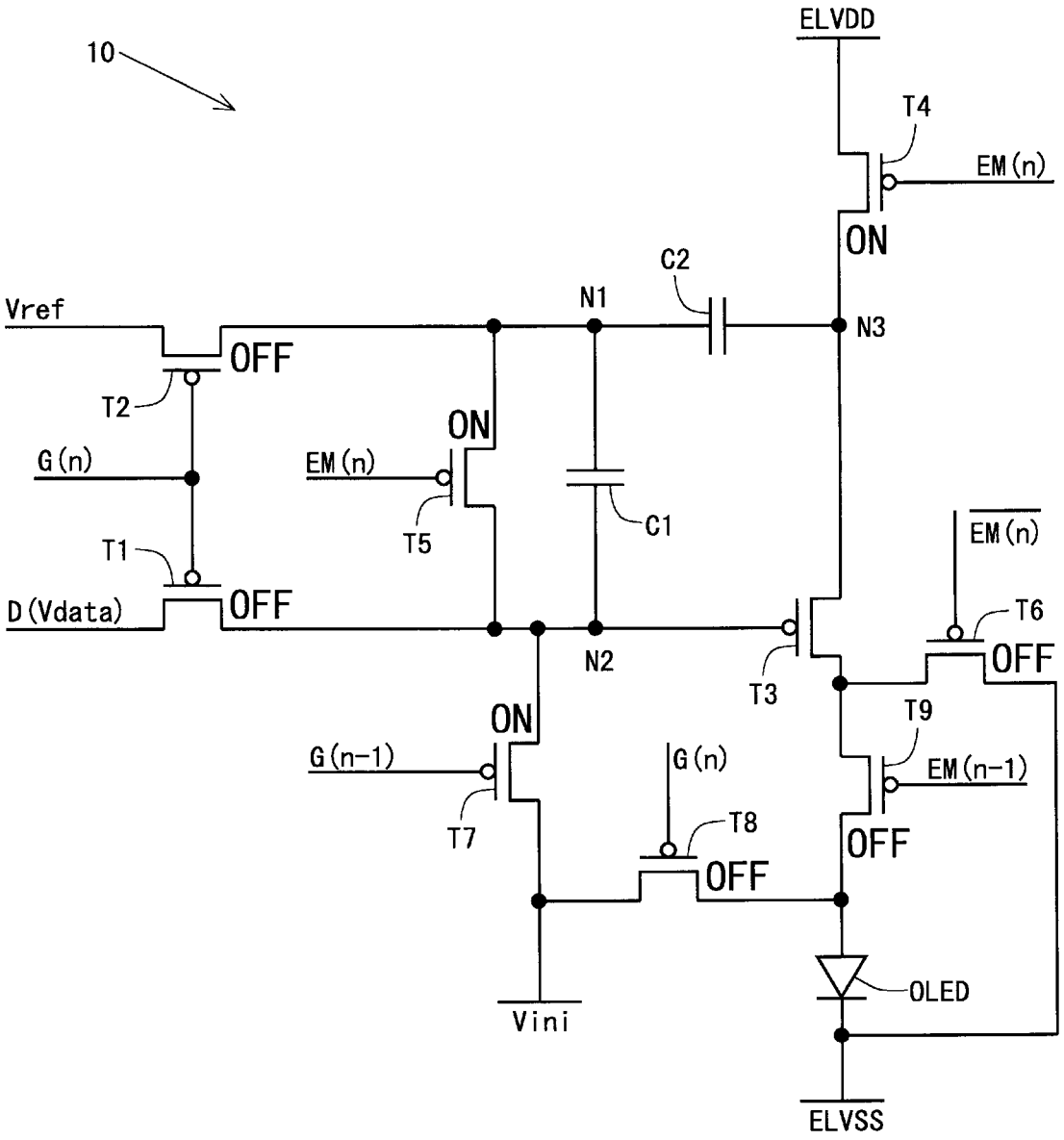
FIG. 12 is a diagram for describing actions in an initialization period in the second embodiment.

At the time t20, the light emission control signal EM(n−1) is changed from the low level to the high level, and the scanning signal G(n−1) is changed from the high level to the low level. This turns off the initialization control transistor T9, and turns on the first initialization transistor T7, as illustrated in FIG. 12. By the initialization control transistor T9 being turned off, the supply of the drive current to the organic EL element OLED is blocked, and the organic EL element OLED is turned to a non-emitting state (switch-off state). By the first initialization transistor T7 being turned on, the initialization voltage *Vini* is supplied to the second node N2. At this time, since the short-circuit control transistor T5 is in the on state, the first node N1 and the second node N2 are in a short-circuited state. Therefore, the initialization voltage *Vini* is also supplied to the first node N1. As described above, in the initialization period, the potential V1 of the first node N1 and the potential V2 of the second node N2 change toward potentials based on the initialization voltage *Vini*. In this manner, the gate voltage of the drive transistor T3 is initialized in the initialization period.

At the time t21, the scanning signal G(n−1) is changed from the low level to the high level. As a result, the first initialization transistor T7 is turned off, and the supply of the initialization voltage *Vini* to the first node N1 and the second node N2 is ended. At time t22, the voltage level of the data voltage Vdata comes to be a desired voltage level for the pixel circuit 10 located in the n-th row.

Figure 13:
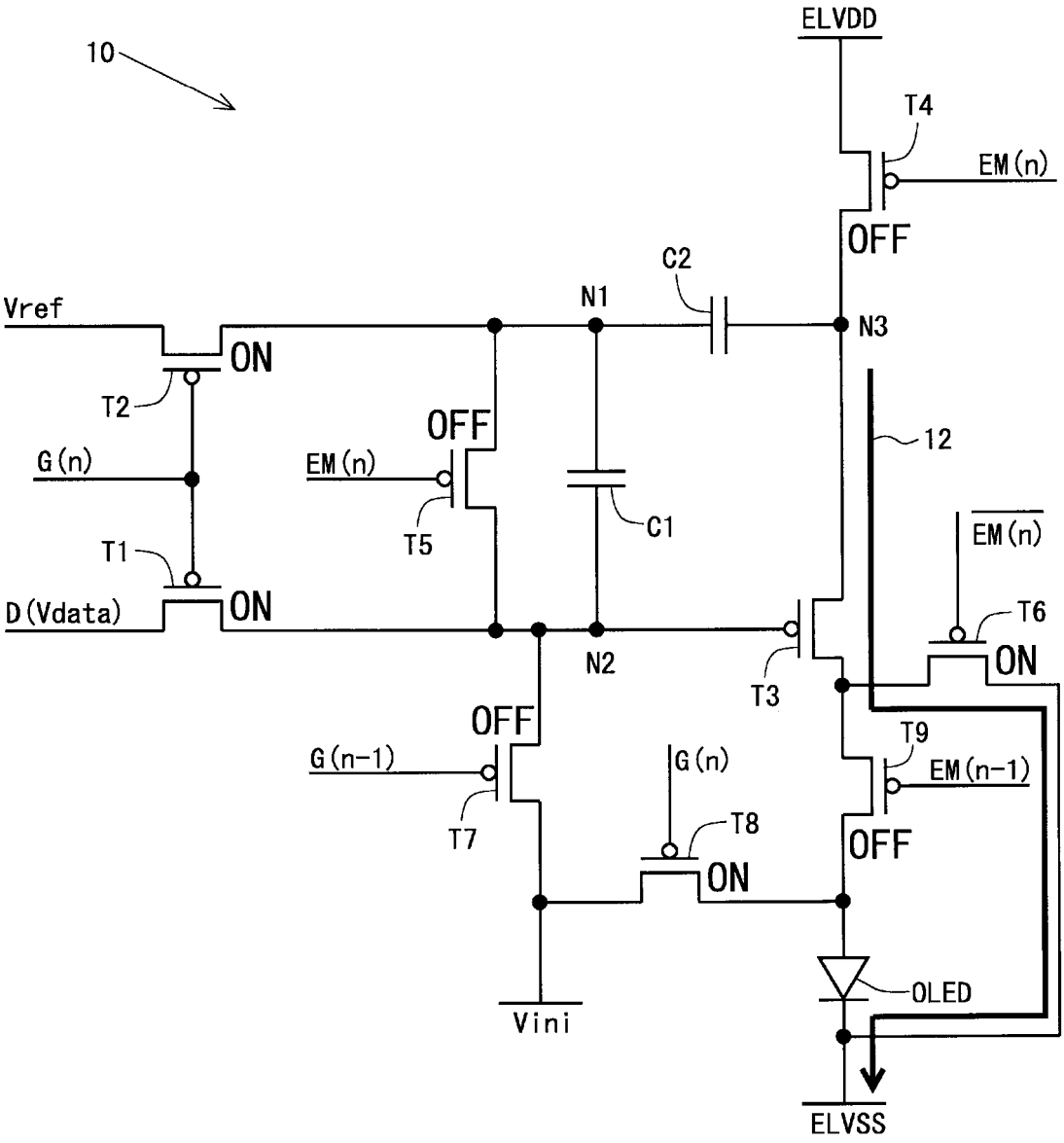
FIG. 13 is a diagram for describing actions in a data writing period in the second embodiment.

At the time t23, the light emission control signal EM(n) is changed from the low level to the high level. This turns off the light emission control transistor T4 and the short-circuit control transistor T5, and turns on the electric discharge control transistor T6, as illustrated in FIG. 13. Since the light emission control transistor T4 is in the off state, the state in which the supply of the drive current to the organic EL element OLED is blocked is maintained. In addition, by the short-circuit control transistor T5 being turned off, the first node N1 and the second node N2 are electrically disconnected.

At the time t23, the scanning signal G(n) is changed from the high level to the low level. This turns on the first writing control transistor T1, the second writing control transistor T2, and the second initialization transistor T8, as illustrated in FIG. 13. By the second initialization transistor T8 being turned on, the initialization voltage *Vini* is supplied to the anode terminal of the organic EL element OLED. In this manner, the anode voltage of the organic EL element OLED is initialized in the data writing period. When the first writing control transistor T1 is turned on, the data voltage Vdata is supplied to the second node N2; when the second writing control transistor T2 is turned on, the reference voltage Vref is supplied to the first node N1. Thus, the potential of the first node N1 changes toward a potential based on the reference voltage Vref, and the potential of the second node N2 changes toward a potential based on the data voltage Vdata. As a result, an electrical charge Q(C1)1*a* expressed by the above Equation (5) is accumulated on the first electrode side (first node N1 side) of the first capacitor C1, and an electrical charge Q(C1)2*a* expressed by the above Equation (6) is accumulated on the second electrode side (second node N2 side) of the first capacitor C1.

Since the light emission control transistor T4 is in the off state and the electric discharge control transistor T6 is in the on state, the potential of the third node N3 decreases because the electrical charge flows out from the third node N3 passing through the drive transistor T3 and the electric discharge control transistor T6, as indicated by an arrow denoted by a reference sign 12 in FIG. 13. To be specific, the potential V3 of the third node N3 decreases until a difference between the potential V2 of the second node N2 and the potential V3 of the third node N3 becomes equal to a threshold voltage Vth of the drive transistor T3 (where a relation of "V2<V3" is satisfied). This causes the potential V3 of the third node N3 to be "Vdata+Vth". As a result, an electrical charge Q(C2)1*a* expressed by the above Equation (7) is accumulated on the first electrode side (first node N1 side) of the second capacitor C2.

As discussed above, at the end time point of the data writing period, an electrical charge Q(N1)a expressed by the above Equation (8) is accumulated in the first node N1, and an electrical charge Q(N2)a expressed by the above Equation (9) is accumulated in the second node N2.

Figure 14:
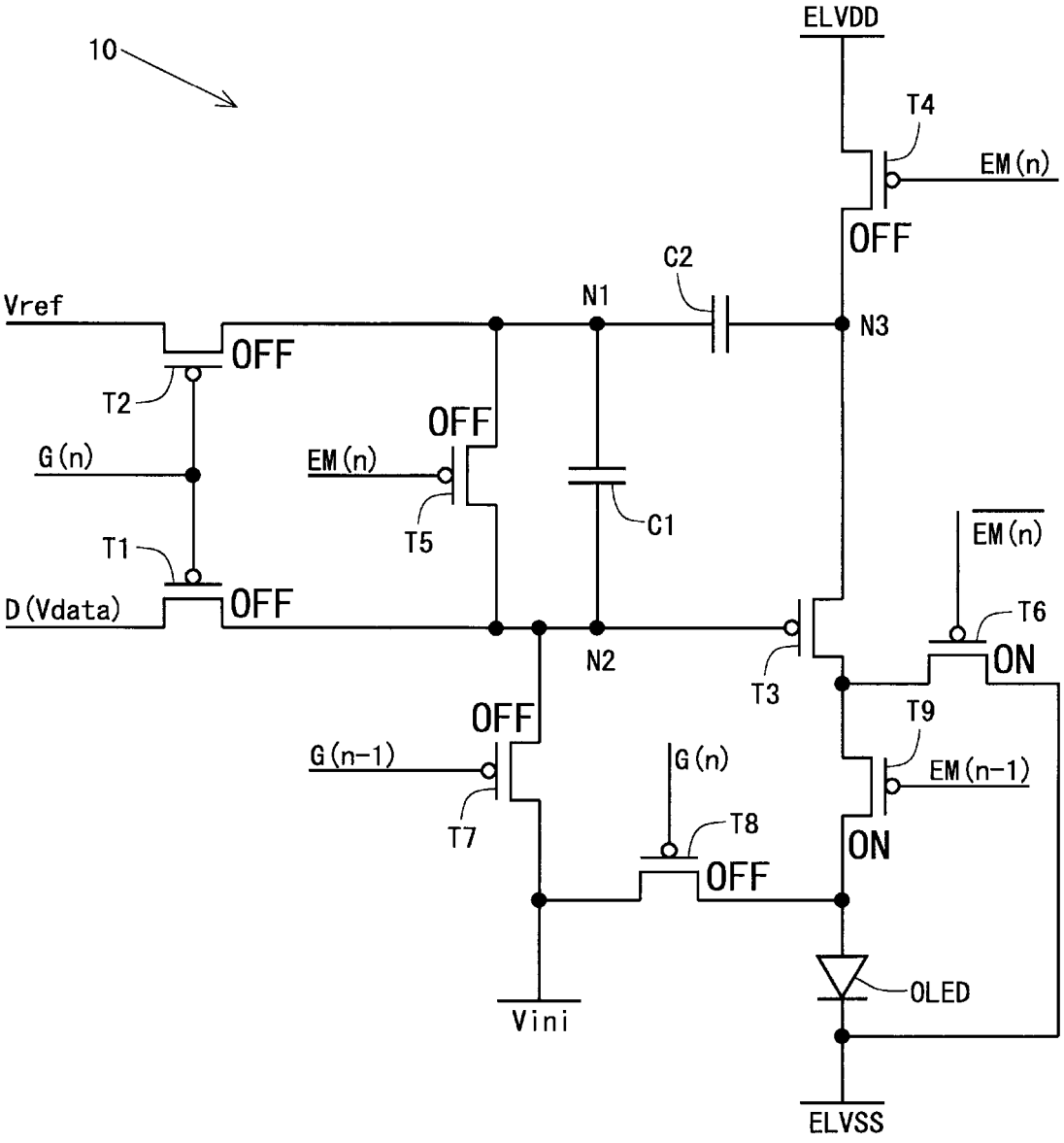
FIG. 14 is a diagram for describing actions in a light emission preparation period in the second embodiment.

At the time t24, the scanning signal G(n) is changed from the low level to the high level. This turns off the first writing control transistor T1, the second writing control transistor T2, and the second initialization transistor T8, as illustrated in FIG. 14. By the second initialization transistor T8 being turned off, the supply of the initialization voltage *Vini* to the anode terminal of the organic EL element OLED is ended. Note that, even when the first writing control transistor T1 and the second writing control transistor T2 are in the off state, there is no change in the electrical charge accumulated in the first capacitor C1. Because of this, during the light emission preparation period, a state where the electrical charge Q(N1)a expressed by the above Equation (8) is accumulated in the first node N1 is maintained, and a state where the electrical charge Q(N2)a expressed by the above Equation (9) is accumulated in the second node N2 is maintained. At the time t24, the light emission control signal EM(n−1) changes from the high level to the low level. This turns on the initialization control transistor T9, as illustrated in FIG. 14. At the time t25, the voltage level of the data voltage Vdata comes to be a desired voltage level for the pixel circuit 10 located in the (n+1)-th row.

At the time t26, the light emission control signal EM(n) is changed from the high level to the low level. This turns on the light emission control transistor T4 and the short-circuit control transistor T5, and turns off the electric discharge control transistor T6, as illustrated in FIG. 11. By the short-circuit control transistor T5 being turned on, the first node N1 and the second node N2 are short-circuited. As a result, the potential V1 of the first node N1 and the potential V2 of the second node N2 become equal to each other. Thus, both an electrical charge Q(C1)1*b* accumulated on the first electrode side (first node N1 side) of the first capacitor C1 and an electrical charge Q(C1)2*b* accumulated on the second electrode side (second node N2 side) of the first capacitor C1 become 0. The magnitude of an electrical charge Q(C2)1*b* accumulated on the first electrode side (first node N1 side) of the second capacitor C2 is expressed by the above Equation (10).

As described above, in the light emission period, the magnitude of an electrical charge Q(N1)b accumulated in the first node N1 is expressed by the above Equation (11), and the magnitude of an electrical charge Q(N2)b accumulated in the second node N2 is expressed by the above Equation (12).

Here, even in the light emission preparation period (see FIG. 14) and the light emission period (see FIG. 11), the first writing control transistor T1 and the second writing control transistor T2 are in the off state. Accordingly, similarly to the first embodiment, a drive current Ioled during the light emission period is determined by the above Equation (17). The above Equation (17) does not contain the term of the threshold voltage Vth. In other words, regardless of the magnitude of the threshold voltage Vth of the drive transistor T3, the drive current Ioled according to the magnitude of the data voltage Vdata is supplied to the organic EL element OLED. Thus, a variation in the threshold voltage Vth of the drive transistor T3 is compensated.

In the present embodiment, the actions performed in the period from the time t20 to the time t21 correspond to initialization processing, the actions performed in the period from the time t23 to the time t24 correspond to data writing processing, and the actions performed in the period before the time t20 and the period after the time t26 correspond to light emission processing.

2.4 Effects

As in the first embodiment, also in the present embodiment, an organic EL display device able to compensate for the variation in the threshold voltage Vth of the drive transistor T3 is achieved without causing a variation in luminance. According to the present embodiment, the gate voltage of the drive transistor T3 (the potential V2 of the second node N2) is initialized before the data is written, and the anode voltage of the organic EL element OLED is initialized before the organic EL element OLED emits light. As a result, the influence of the data voltage Vdata of the previous frame is canceled, so that the display quality is improved.

2.5 Modification Example

Similarly to the modification example of the first embodiment, it is also possible to employ the pixel circuit 10 in a configuration in which the first capacitor C1 is removed from the configuration illustrated in FIG. 9.

3. Third Embodiment

Figure 1:
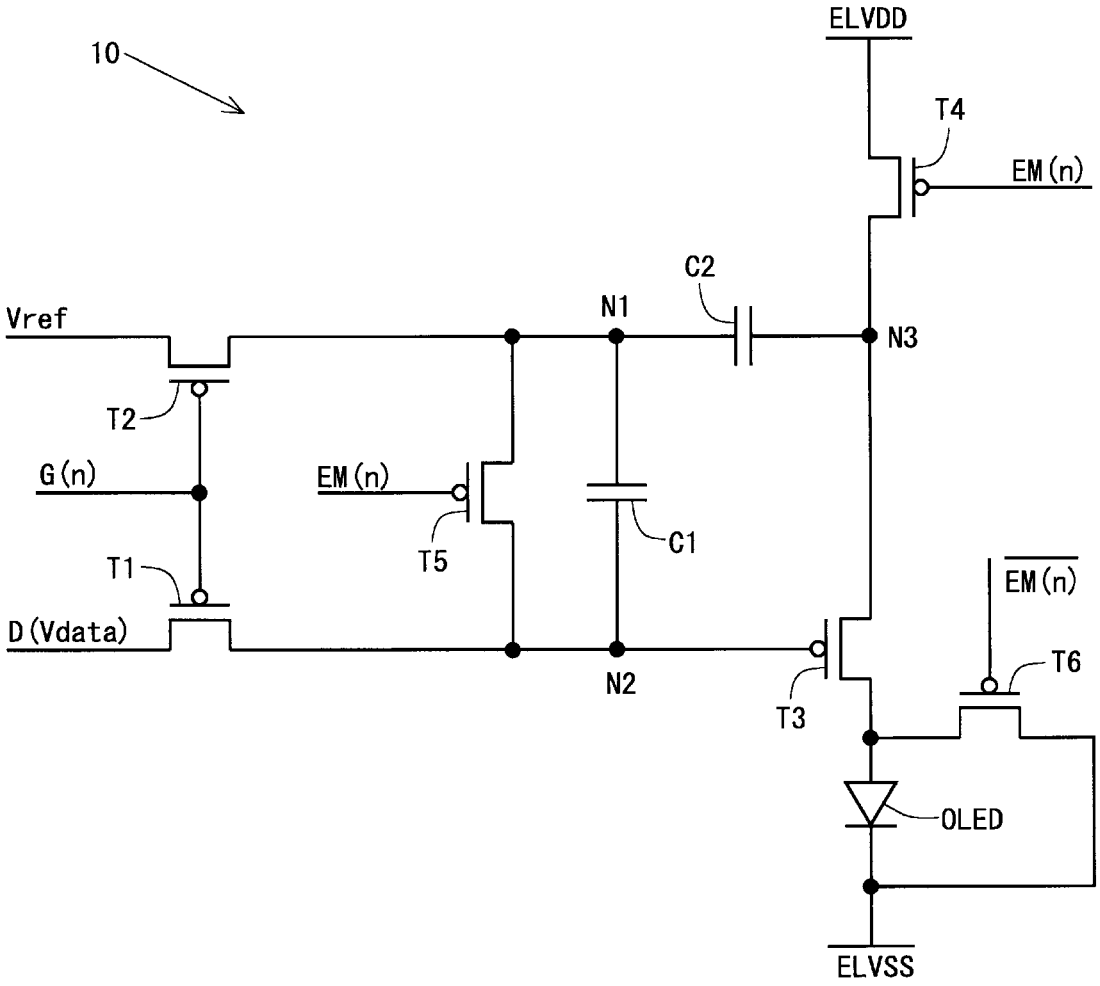
FIG. 1 is a circuit diagram illustrating a configuration of a pixel circuit in a first embodiment.
Figure 15:
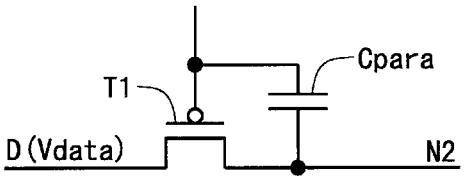
FIG. 15 is a diagram for describing presence of parasitic capacitance.

With regard to the pixel circuit 10 having the configuration illustrated in FIG. 1, FIG. 9, and the like, parasitic capacitance Cpara is normally formed between the gate terminal and the second conduction terminal of the first writing control transistor T1, as illustrated in FIG. 15. Because of this, when the first writing control transistor T1 changes from the on state to the off state, the potential of the second node N2 increases somewhat as the gate potential of the first writing control transistor T1 increases. In this regard, according to the configurations of the first embodiment, the second embodiment, and the modification examples thereof, both the first node N1 and the second node N2 become floating nodes when the data writing period ends, and therefore the potential of the second node N2 is likely to fluctuate in the light emission preparation period. When the potential of the second node N2 changes after the end time point of the data writing period, the size of the drive current Ioled supplied to the organic EL element OLED is deviated from the expected size. As a result, the display quality is degraded. Then, an embodiment able to prevent the occurrence of such phenomenon will be described as a third embodiment. Different points from the first embodiment will be mainly described below.

3.1 Overall Configuration

The overall configuration in the present embodiment is substantially similar to that of the first embodiment (see FIG. 2). Note that, however, in the present embodiment, i control lines are so disposed in the display portion 100 as to correspond to i scanning signal lines GL(1) to GL(i) on a one-to-one basis, and a control line driver for driving the i control lines is provided, for example, near the gate driver 300. Control signals are supplied from the control line driver to the i control lines. In the following, a control signal supplied to the control line of the n-th row is denoted by a reference sign G'(n).

3.2 Configuration of Pixel Circuit

Figure 16:
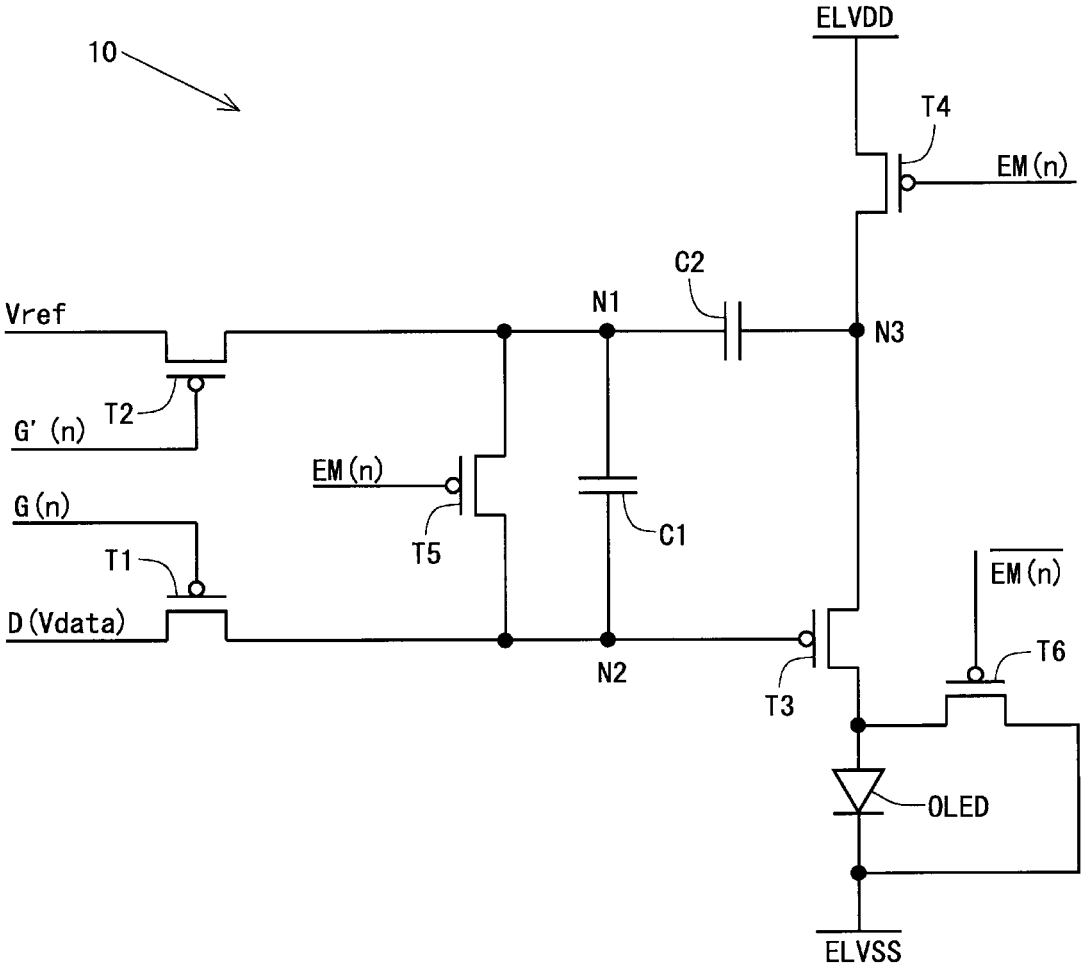
FIG. 16 is a circuit diagram illustrating a configuration of a pixel circuit in a third embodiment.

FIG. 16 is a circuit diagram illustrating a configuration of a pixel circuit 10 in the present embodiment. Unlike the first embodiment, the gate terminal of a second writing control transistor T2 is connected to a control line to be supplied with the control signal G'(n). Accordingly, in the present embodiment, the gate terminal of a first writing control transistor T1 is supplied with a scanning signal G(n), and the gate terminal of the second writing control transistor T2 is supplied with the control signal G'(n).

3.3 Driving Method

Figure 17:
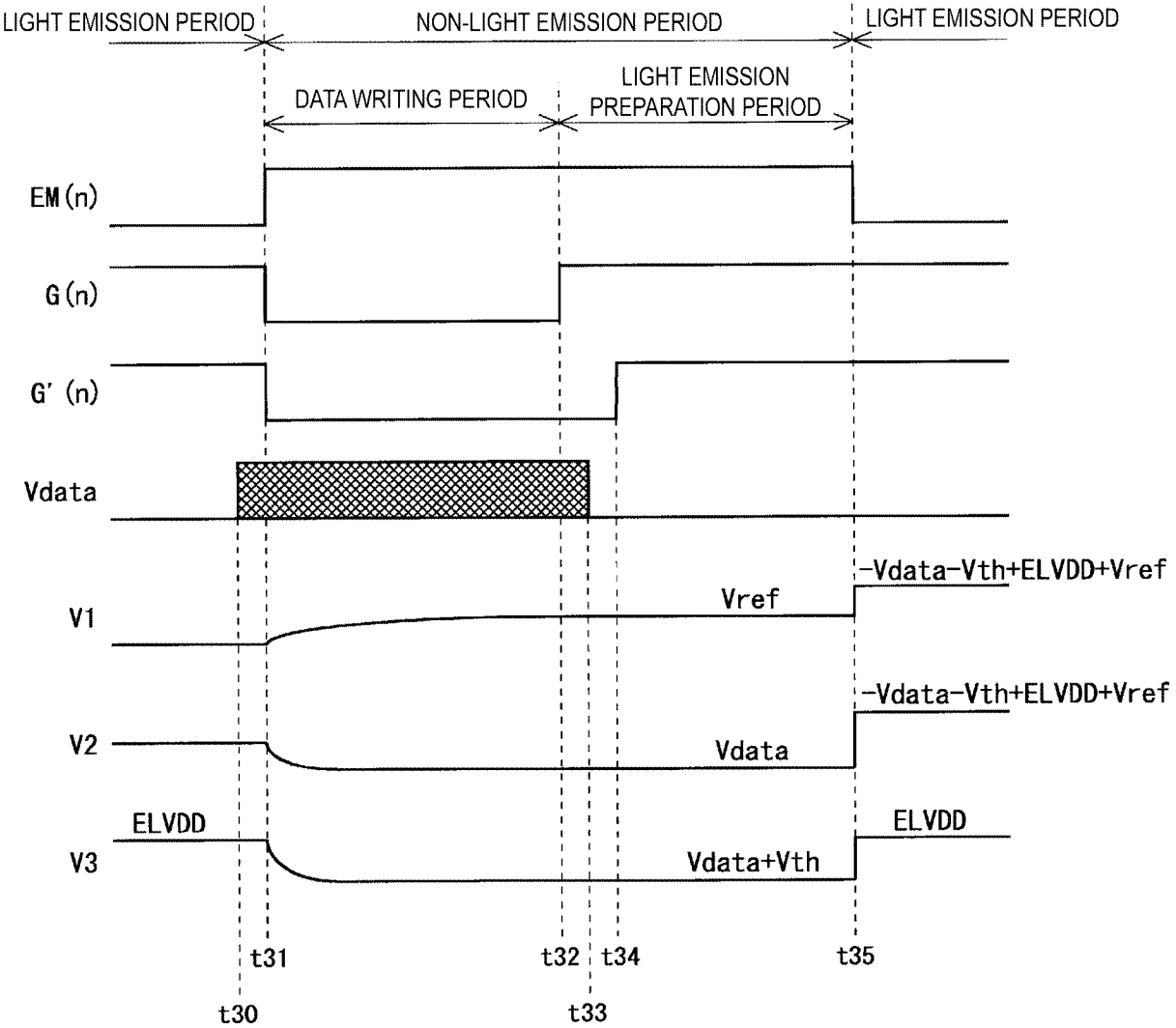
FIG. 17 is a timing chart for describing a driving method for a pixel circuit in the third embodiment.

Next, a driving method will be described. FIG. 17 is a timing chart for describing a driving method for the pixel circuit (the pixel circuit illustrated in FIG. 16) 10 located in the n-th row. A period before time t31 and a period after time t35 are light emission periods of the pixel circuit 10 located in the n-th row, and a period from the time t31 to the time t35 is a non-light emission period of the pixel circuit 10 located in the n-th row.

Because the voltage level of the scanning signal G(n) and the voltage level of the control signal G'(n) similarly change until a time point immediately before the time t32, actions similar to those performed in the first embodiment until a time point immediately before the time t12 (see FIG. 5) are performed in the present embodiment.

Figure 18:
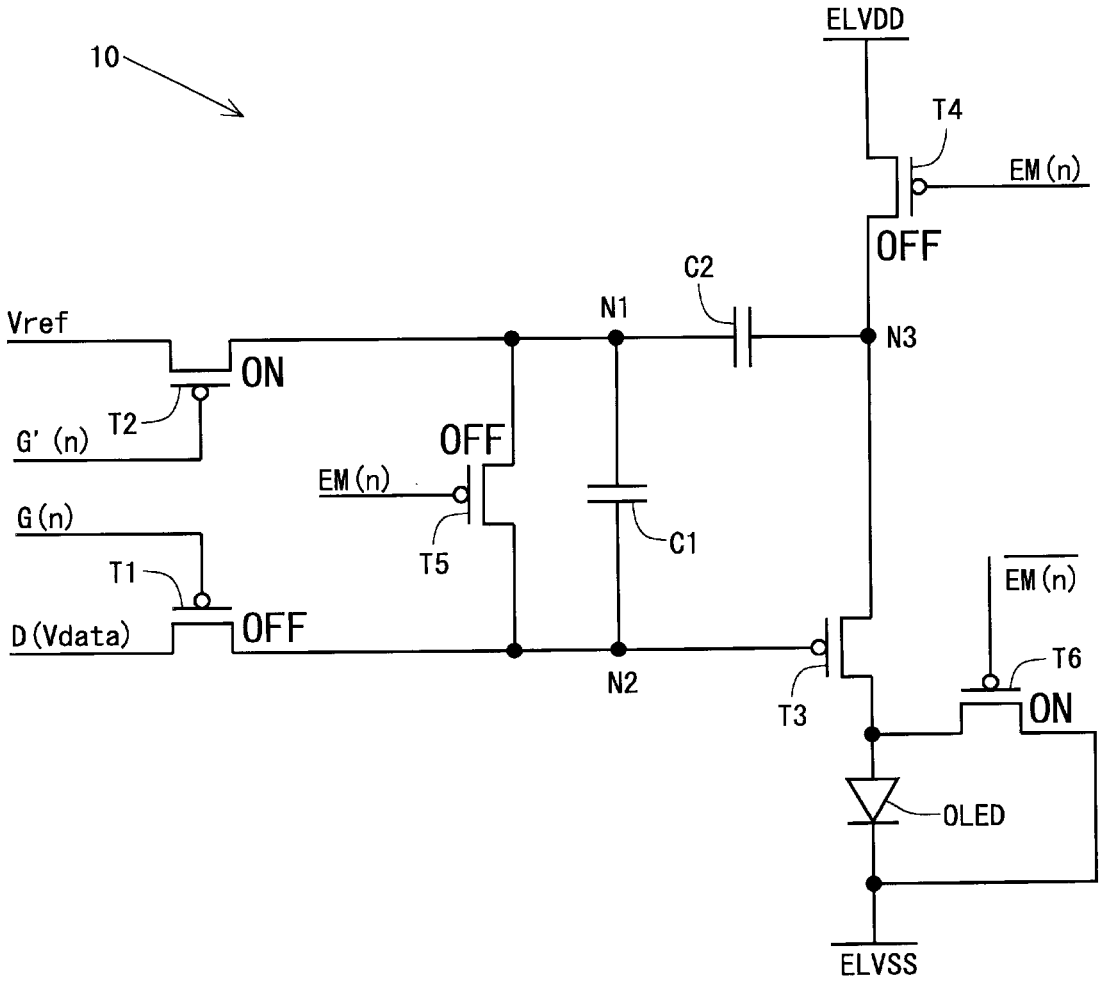
FIG. 18 is a diagram for describing a state of a pixel circuit immediately after a scanning signal has changed from a low level to a high level in the third embodiment.

At the time t32, the scanning signal G(n) is changed from the low level to the high level. This turns off the first writing control transistor T1, as illustrated in FIG. 18.

At this time, since the control signal G'(n) is maintained at the low level, the second writing control transistor T2 is maintained in the on state.

Here, a potential V2 of a second node N2 attempts to rise due to the presence of the parasitic capacitance Cpara of the first writing control transistor T1 (see FIG. 15) as discussed above; however, since the second writing control transistor T2 is in the on state, a potential V1 of a first node N1 is fixed to a potential based on a reference voltage Vref, and the electrical charge may be released to a reference power source wiring line via a first capacitor C1. Accordingly, during the light emission preparation period, the potential V2 of the second node N2 is maintained at a potential based on a data voltage Vdata.

Figure 19:
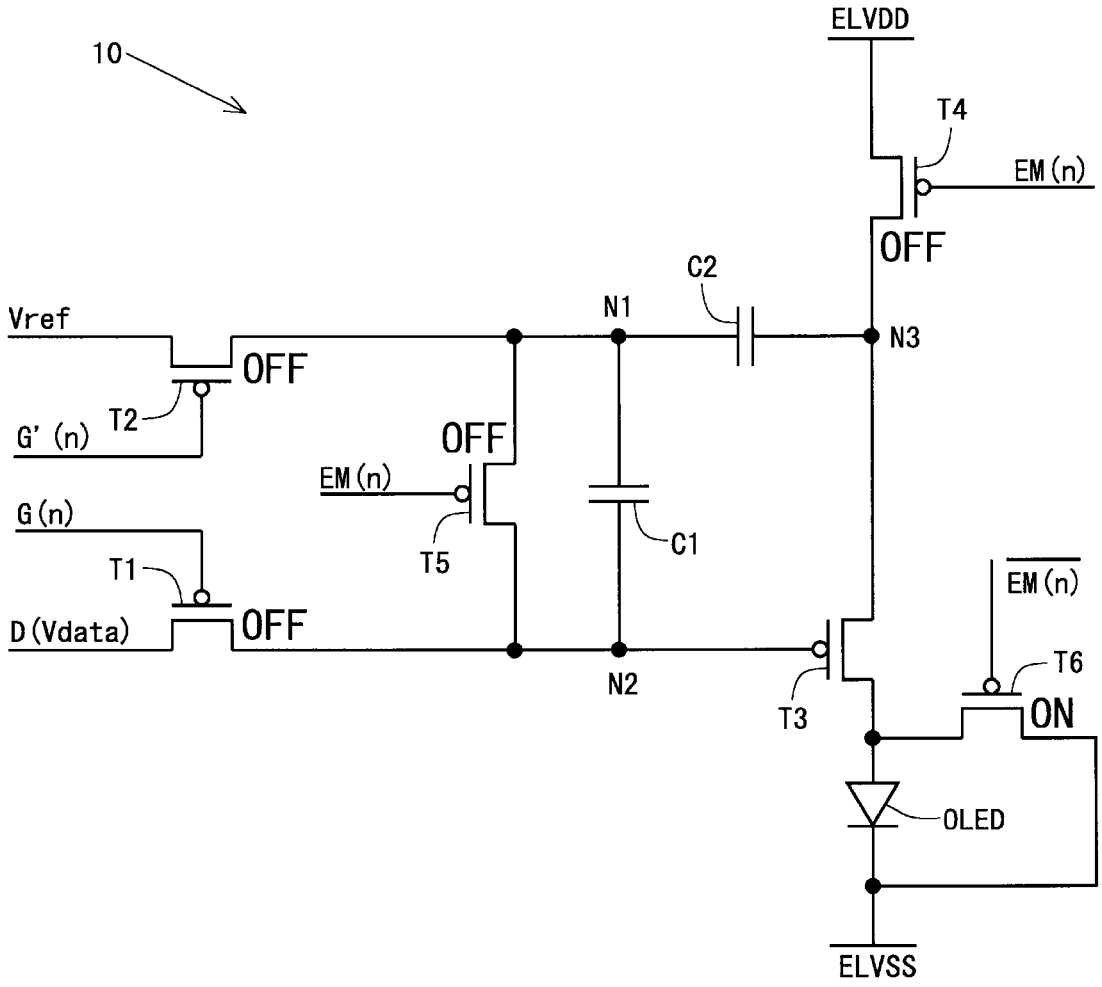
FIG. 19 is a diagram for describing a state of a pixel circuit immediately after a control signal has changed from a low level to a high level in the third embodiment.
Figure 20:
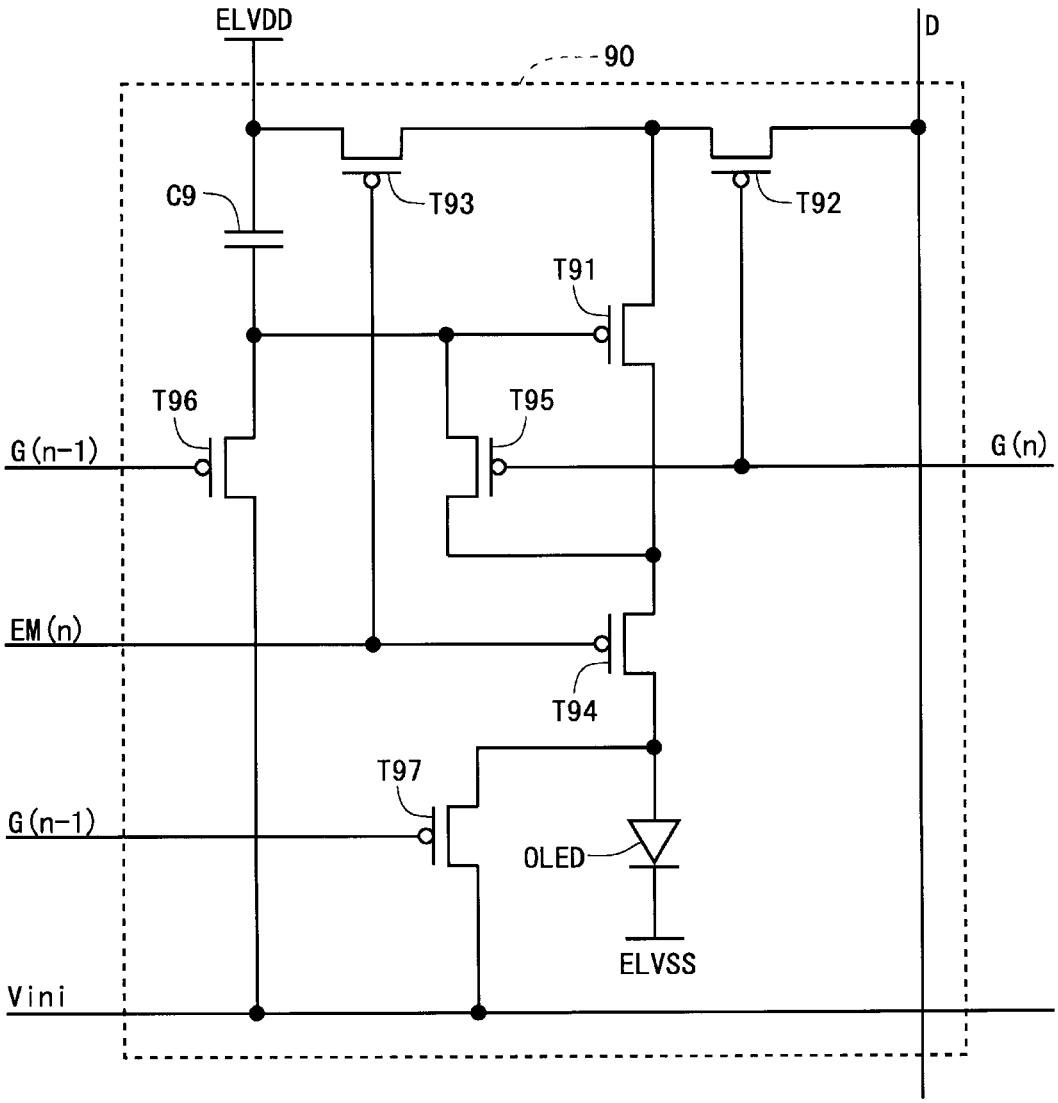
FIG. 20 is a circuit diagram illustrating a configuration of a known pixel circuit.
Figure 21:
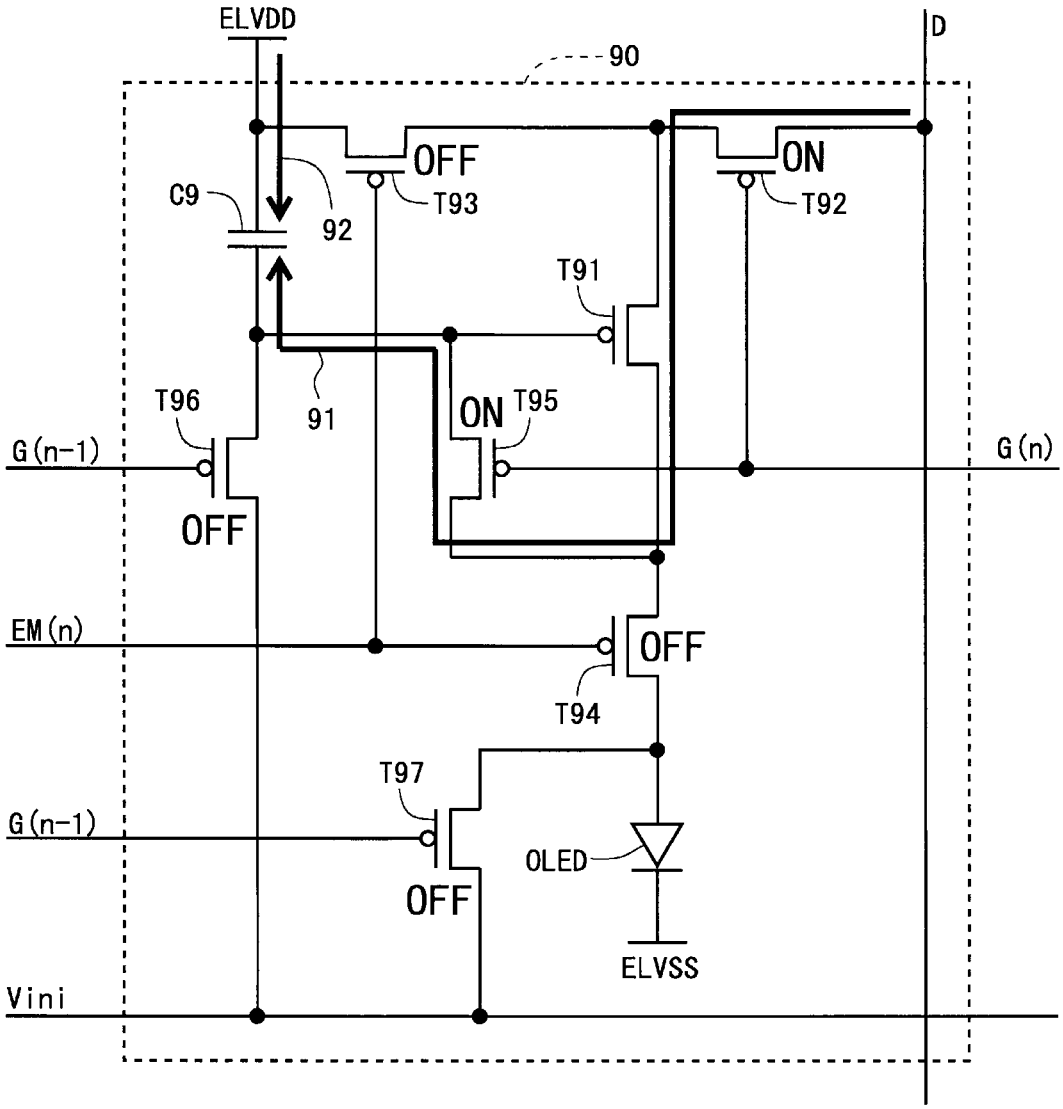
FIG. 21 is a diagram for describing actions of a known pixel circuit.

At the time t33, the voltage level of the data voltage Vdata comes to be a desired voltage level for the pixel circuit 10 located in the (n+1)-th row. At the time t34, the control signal G'(n) is changed from the low level to the high level. This turns off the second writing control transistor T2, as illustrated in FIG. 19. As discussed above, in the present embodiment, after the second electrode of the first capacitor C1 and the data signal line are electrically disconnected, the first electrode of the first capacitor C1 and the reference power source wiring line are electrically disconnected. At the time t35, actions similar to those performed in the first embodiment at the time t14 (see FIG. 5) are performed in the present embodiment.

In the present embodiment, the actions performed in the period from the time t31 to the time t32 correspond to data writing processing, and the actions performed in the period before the time t31 and the period after the time t35 correspond to light emission processing.

3.4 Effects

As in the first embodiment, also in the present embodiment, an organic EL display device able to compensate for the variation in the threshold voltage Vth of the drive transistor T3 is achieved without causing a variation in luminance. Furthermore, according to the present embodiment, after the end of the data writing period, the second writing control transistor T2 is turned off after a predetermined period of time has passed from the time point when the first writing control transistor T1 was turned off. Because of this, even in a case where the potential V2 of the second node N2 attempts to rise due to the presence of the parasitic capacitance when the first writing control transistor T1 changes from the on state to the off state, the potential V2 of the second node N2 is maintained at the potential based on the data voltage Vdata since the electrical charge may be released to the reference power source wiring line via the first capacitor C1. As a result, the display quality is prevented from being degraded.

4. Other Matters

Although the above embodiments (including the modification example) are described while citing an example of an organic EL display device, types of display devices are not particularly limited. The disclosure may also be applied to an inorganic EL display device including an inorganic light emitting diode, a quantum dot light emitting diode (QLED) display device including a QLED, and the like, as a display device (current-driven display device) including a display element whose luminance is controlled by a current.

REFERENCE SIGNS LIST

10 Pixel circuit
100 Display portion
200 Display control circuit
300 Gate driver
400 Emission driver
500 Source driver
DL(1)-DL(j) Data signal line
GL(1)-GL(i) Scanning signal line
EML(1)-EML(i) Light emission control line
T1 First writing control transistor
T2 Second writing control transistor
T3 Drive transistor
T4 Light emission control transistor
T5 Short-circuit control transistor
T6 Electric discharge control transistor
T7 First initialization transistor
T8 Second initialization transistor
T9 Initialization control transistor
D Data signal
G(1)-G(i) Scanning signal
EM(1)-EM(i) Light emission control signal
Vdata Data voltage
Vini Initialization voltage
Vref Reference voltage
ELVDD High-level power supply voltage
ELVSS Low-level power supply voltage

The invention claimed is:

1. A display device comprising:

a pixel circuit arranged in a matrix shape;

a first power source wiring line supplied with a first power supply voltage;

a second power source wiring line supplied with a second power supply voltage at a lower voltage level than a voltage level of the first power supply voltage;

a third power source wiring line supplied with a third power supply voltage; and a data signal line provided for each column and supplied with a data voltage, the pixel circuit including:

a display element that is provided between the first power source wiring line and the second power source wiring line, and emits light with luminance in accordance with an amount of a current supplied;

a first capacitance element having a first electrode to be supplied with the third power supply voltage during a data writing period, and a second electrode to be supplied with the data voltage during a data writing period;

a drive transistor that is provided to be connected in series to the display element between the first power source wiring line and the second power source wiring line, and has a control terminal connected to the second electrode of the first capacitance element, a first conduction terminal to be supplied with the first power supply voltage during a light emission period, and a second conduction terminal;

a second capacitance element having a first electrode connected to the first electrode of the first capacitance element, and a second electrode connected to the first conduction terminal of the drive transistor; and a short-circuit control transistor having a control terminal to be supplied with a signal that becomes active during a light emission period, a first conduction terminal connected to the first electrode of the first capacitance element, and a second conduction terminal connected to the second electrode of the first capacitance element, wherein the display device further comprising:

an initialization power source wiring line supplied with an initialization voltage for initializing the pixel circuit, the display element includes a first electrode provided electrically on the first power source wiring line side, and a second electrode provided electrically on the second power source wiring line side, and the pixel circuit further includes a first initialization transistor having a control terminal to be supplied with a signal that becomes active during an initialization period that is set before a data writing period, a first conduction terminal connected to the second electrode of the first capacitance element, and a second conduction terminal connected to the initialization power source wiring line, a second initialization transistor having a control terminal to be supplied with a signal that becomes active during a data writing period, a first conduction terminal connected to the first electrode of the display element, and a second conduction terminal connected to the initialization power source wiring line, and an initialization control transistor having a control terminal to be supplied with a signal that becomes active during an initialization period, a first conduction terminal connected to the second conduction terminal of the drive transistor, and a second conduction terminal connected to the first electrode of the display element.

2. The display device according to claim 1, wherein the third power supply voltage is a fixed voltage.

3. The display device according to claim 2, wherein a voltage level of the third power supply voltage is equal to or greater than a voltage level of the second power supply voltage and equal to or lower than a voltage level of the first power supply voltage.

4. The display device according to claim 1, wherein the pixel circuit further includes an electric discharge control transistor having a control terminal to be supplied with a signal that becomes active during a period other than a light emission period, a first conduction terminal connected to the second conduction terminal of the drive transistor, and a second conduction terminal connected to the second power source wiring line.

5. The display device according to claim 1, wherein the pixel circuit further includes a first writing control transistor having a control terminal to be supplied with a signal that becomes active during a data writing period, a first conduction terminal to be supplied with the data voltage, and a second conduction terminal connected to the second electrode of the first capacitance element, a second writing control transistor having a control terminal to be supplied with a signal that becomes active during a data writing period, a first conduction terminal connected to the third power source wiring line, and a second conduction terminal connected to the first electrode of the first capacitance element, and a light emission control transistor having a control terminal to be supplied with a signal that becomes active during a light emission period, a first conduction terminal connected to the first power source wiring line, and a second conduction terminal connected to the first conduction terminal of the drive transistor.

6. The display device according to claim 1, wherein the third power supply voltage is the initialization voltage.

7. The display device according to claim 1, wherein a capacitance value of the second capacitance element is greater than a capacitance value of the first capacitance element.

8. The display device according to claim 1, wherein the display element is an organic EL element.

9. A driving method for a display device equipped with a pixel circuit arranged in a matrix shape, a first power source wiring line supplied with a first power supply voltage, a second power source wiring line supplied with a second power supply voltage at a lower voltage level than a voltage level of the first power supply voltage, a third power source wiring line supplied with a third power supply voltage, and a data signal line provided for each column and supplied with a data voltage, the pixel circuit including:

a display element that is provided between the first power source wiring line and the second power source wiring line, and emits light with luminance in accordance with an amount of a current supplied;

a first capacitance element having a first electrode and a second electrode;

a drive transistor that is provided to be connected in series to the display element between the first power source wiring line and the second power source wiring line, and has a control terminal connected to the second electrode of the first capacitance element, a first conduction terminal, and a second conduction terminal; and a second capacitance element having a first electrode connected to the first electrode of the first capacitance element and a second electrode connected to the first conduction terminal of the drive transistor, and the driving method comprising:

electrically connecting the first electrode of the first capacitance element and the third power source wiring line and electrically connecting the second electrode of the first capacitance element and the data signal line as data writing processing, in a state in which the first electrode and the second electrode of the first capacitance element are electrically disconnected, and the first conduction terminal of the drive transistor and the first power source wiring line are electrically disconnected; and electrically connecting the first electrode and the second electrode of the first capacitance element and electrically connecting the first conduction terminal of the drive transistor and the first power source wiring line as light emission processing, in a state in which the first electrode of the first capacitance element and the third power source wiring line are electrically disconnected, and the second electrode of the first capacitance element and the data signal line are electrically disconnected, wherein the display device further includes an initialization power source wiring line provided with an initialization voltage for initializing the pixel circuit, and the driving method further includes electrically connecting the second electrode of the first capacitance element and the initialization power source wiring line as initialization processing, in a state in which a current supply to the display element is blocked and the first electrode and the second electrode of the first capacitance element are electrically connected.

10. A driving method for a display device equipped with a pixel circuit arranged in a matrix shape, a first power source wiring line supplied with a first power supply voltage, a second power source wiring line supplied with a second power supply voltage at a lower voltage level than a voltage level of the first power supply voltage, a third power source wiring line supplied with a third power supply voltage, and a data signal line provided for each column and supplied with a data voltage, the pixel circuit including:

a display element that is provided between the first power source wiring line and the second power source wiring line, and emits light with luminance in accordance with an amount of a current supplied;

a first capacitance element having a first electrode and a second electrode;

a drive transistor that is provided to be connected in series to the display element between the first power source wiring line and the second power source wiring line, and has a control terminal connected to the second electrode of the first capacitance element, a first conduction terminal, and a second conduction terminal; and a second capacitance element having a first electrode connected to the first electrode of the first capacitance element and a second electrode connected to the first conduction terminal of the drive transistor, and the driving method comprising:

electrically connecting the first electrode of the first capacitance element and the third power source wiring line and electrically connecting the second electrode of the first capacitance element and the data signal line as data writing processing, in a state in which the first electrode and the second electrode of the first capacitance element are electrically disconnected, and the first conduction terminal of the drive transistor and the first power source wiring line are electrically disconnected; and electrically connecting the first electrode and the second electrode of the first capacitance element and electrically connecting the first conduction terminal of the drive transistor and the first power source wiring line as light emission processing, in a state in which the first electrode of the first capacitance element and the third power source wiring line are electrically disconnected, and the second electrode of the first capacitance element and the data signal line are electrically disconnected, wherein the display element includes a first electrode provided electrically on the first power source wiring line side and a second electrode provided electrically on the second power source wiring line side, and the first electrode of the display element and an initialization power source wiring line supplied with an initialization voltage are electrically connected in the data writing processing.

11. The driving method according to claim 9, further comprising:

causing a state of the pixel circuit to be such that the first electrode and the second electrode of the first capacitance element are electrically disconnected, the first conduction terminal of the drive transistor and the first power source wiring line are electrically disconnected, the first electrode of the first capacitance element and the third power source wiring line are electrically disconnected, and the second electrode of the first capacitance element and the data signal line are electrically disconnected, as light emission preparation processing.

12. The driving method according to claim 11, wherein, in the light emission preparation processing, after the second electrode of the first capacitance element and the data signal line are brought into an electrically disconnected state, the first electrode of the first capacitance element and the third power source wiring line are brought into an electrically disconnected state.

13. The driving method according to claim 9, wherein, in the data writing processing, the second conduction terminal of the drive transistor and the second power source wiring line are electrically connected in a state in which a current supply to the display element is blocked.

14. The driving method according to claim 10, further comprising:

causing a state of the pixel circuit to be such that the first electrode and the second electrode of the first capacitance element are electrically disconnected, the first conduction terminal of the drive transistor and the first power source wiring line are electrically disconnected, the first electrode of the first capacitance element and the third power source wiring line are electrically disconnected, and the second electrode of the first capacitance element and the data signal line are electrically disconnected, as light emission preparation processing.

15. The driving method according to claim 14, wherein, in the light emission preparation processing, after the second electrode of the first capacitance element and the data signal line are brought into an electrically disconnected state, the first electrode of the first capacitance element and the third power source wiring line are brought into an electrically disconnected state.

16. The driving method according to claim 10, wherein, in the data writing processing, the second conduction terminal of the drive transistor and the second power source wiring line are electrically connected in a state in which a current supply to the display element is blocked.

* * * * *